US009483018B2

(12) United States Patent
Hirasawa et al.

(10) Patent No.: US 9,483,018 B2
(45) Date of Patent: Nov. 1, 2016

(54) COOLING DEVICE AND IMAGE FORMING APPARATUS INCLUDING SAME

(71) Applicants: Tomoyasu Hirasawa, Kanagawa (JP); Kenichi Takehara, Kanagawa (JP); Hiromitsu Fujiya, Kanagawa (JP); Keisuke Yuasa, Kanagawa (JP); Yasuaki Toda, Kanagawa (JP); Yutaka Shoji, Kanagawa (JP); Kenji Ishii, Ibaraki (JP); Makoto Nakura, Ibaraki (JP); Susumu Tateyama, Ibaraki (JP); Hiroaki Miyagawa, Ibaraki (JP); Keisuke Ikeda, Kanagawa (JP); Takeshi Watanabe, Ibaraki (JP)

(72) Inventors: Tomoyasu Hirasawa, Kanagawa (JP); Kenichi Takehara, Kanagawa (JP); Hiromitsu Fujiya, Kanagawa (JP); Keisuke Yuasa, Kanagawa (JP); Yasuaki Toda, Kanagawa (JP); Yutaka Shoji, Kanagawa (JP); Kenji Ishii, Ibaraki (JP); Makoto Nakura, Ibaraki (JP); Susumu Tateyama, Ibaraki (JP); Hiroaki Miyagawa, Ibaraki (JP); Keisuke Ikeda, Kanagawa (JP); Takeshi Watanabe, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/924,148

(22) Filed: Oct. 27, 2015

(65) Prior Publication Data

US 2016/0048106 A1 Feb. 18, 2016

Related U.S. Application Data

(63) Continuation of application No. 14/140,888, filed on Dec. 26, 2013, now Pat. No. 9,217,979.

(30) Foreign Application Priority Data

| | | |
|---|---|---|
| Dec. 27, 2012 | (JP) | 2012-285722 |
| Mar. 4, 2013 | (JP) | 2013-041649 |
| Jul. 8, 2013 | (JP) | 2013-142510 |

(51) Int. Cl.

| | |
|---|---|
| ***G03G 15/20*** | (2006.01) |
| ***G03G 21/20*** | (2006.01) |
| ***G03G 15/00*** | (2006.01) |

(52) U.S. Cl.
CPC ..... *G03G 21/20* (2013.01); *G03G 15/6529* (2013.01); *G03G 15/6573* (2013.01); *G03G 15/2021* (2013.01); *G03G 2215/0129* (2013.01)

(58) Field of Classification Search
CPC ..... G03G 21/20; G03G 15/2021; G03G 2215/0129; G03G 15/6573; G03G 15/6529; B41J 29/377
USPC ..... 399/341, 407
See application file for complete search history.

(56) References Cited

U.S. PATENT DOCUMENTS

| | | | |
|---|---|---|---|
| 5,960,242 | A | 9/1999 | Greive |
| 5,970,301 | A | 10/1999 | De Cock |

(Continued)

FOREIGN PATENT DOCUMENTS

| | | | |
|---|---|---|---|
| JP | 08-129310 | A | 5/1996 |
| JP | 10-221976 | | 8/1998 |

(Continued)

OTHER PUBLICATIONS

Machine translation of JP 2011-057389 (publication date of Mar. 24, 2011) printed on Nov. 20, 2015.*

(Continued)

*Primary Examiner* — Sophia S Chen
(74) *Attorney, Agent, or Firm* — Oblon, McClelland, Maier & Neustadt, L.L.P.

(57) ABSTRACT

A recording-material cooling device includes a first belt, a first cooling unit, and a second cooling unit. The first belt is disposed at a first face side of a recording material. The first cooling unit has a first heat absorbing surface to contact the first belt to absorb heat of the recording material. The second cooling unit has a second heat absorbing surface to directly or indirectly contact the recording material to absorb heat of the recording material. The second cooling unit is disposed at a second face side of the recording material. The first and second cooling units are offset from each other in a transport direction of the recording material. Each of the first and second surfaces has a shape in which an inner area protrudes beyond opposed ends in the transport direction. The first and second surfaces overlap each other in a direction crossing the transport direction.

13 Claims, 29 Drawing Sheets

(56) References Cited

U.S. PATENT DOCUMENTS

| | | | | |
|---|---|---|---|---|
| 2006/0171749 | A1 | 8/2006 | Tomita et al. | |
| 2009/0103959 | A1 | 4/2009 | Koyama et al. | |
| 2011/0064494 | A1 | 3/2011 | Amita et al. | |
| 2012/0315069 | A1 | 12/2012 | Ikeda et al. | |
| 2012/0328343 | A1 | 12/2012 | Kunii et al. | |
| 2013/0121739 | A1* | 5/2013 | Hatazaki ..... | G03G 15/2021 399/341 |
| 2013/0259512 | A1 | 10/2013 | Ikeda et al. | |
| 2014/0060782 | A1 | 3/2014 | Ikeda et al. | |
| 2014/0308057 | A1 | 10/2014 | Tomino | |

FOREIGN PATENT DOCUMENTS

| | | |
|---|---|---|
| JP | 2004-325934 | 11/2004 |
| JP | 2005-084109 | 3/2005 |
| JP | 2006-201657 | 8/2006 |
| JP | 20007-121653 A | 5/2007 |
| JP | 2008-112102 | 5/2008 |
| JP | 2008-170541 | 7/2008 |
| JP | 2009-103822 | 5/2009 |
| JP | 2009-161347 | 7/2009 |
| JP | 2009-236953 | 10/2009 |
| JP | 2011-057389 | 3/2011 |
| JP | 2012-098677 | 5/2012 |
| JP | 2012-173640 | 9/2012 |
| JP | 2013-088564 | 5/2013 |

OTHER PUBLICATIONS

U.S. Appl. No. 13/958,014, filed Aug. 2, 2013.
Extended European Search Report issued on Aug. 7, 2014, in Patent Application No. 14163886.6.
Office Action dated Aug. 22, 2016 for Japanese Patent Application No. 2012-285722.

* cited by examiner

RELATED ART

COOLING DEVICE AND IMAGE FORMING APPARATUS INCLUDING SAME

CROSS-REFERENCE TO RELATED APPLICATIONS

This patent application is a continuation of U.S. application Ser. No. 14/140,888, filed Dec. 26, 2013, which is based on and claims priority pursuant to 35 U.S.C. §119 to Japanese Patent Application Nos. 2012-285722, filed on Dec. 27, 2012, 2013-041649, filed on Mar. 4, 2013, and 2013-142510, filed on Jul. 8, 2013, in the Japan Patent Office. The entire disclosure of each of the above is incorporated by reference herein.

BACKGROUND

1. Technical Field

Exemplary embodiments of this disclosure relate to a cooling device to cool a recording material (for example, a sheet-type recording material) and an image forming apparatus including the cooling device.

2. Description of the Related Art

Image forming apparatuses are used as, for example, copiers, printers, facsimile machines, and multi-functional devices having at least one of the foregoing capabilities. As one type of image forming apparatus, electrophotographic image forming apparatuses are known. Such an electrophotographic image forming apparatus may have a fixing device to fuse toner under heat and fix a toner image on a recording material (e.g., a sheet of paper). Such recording materials having toner images fixed thereon may be stacked on an output tray of the image forming apparatus.

In such a case, the recording materials having toner images are stacked one on another in heated state. As a result, toner is softened by heat retained in the stacked recording materials, and pressure due to the weight of the stacked recording materials may cause the recording materials to adhere to each other with softened toner. If the recording materials adhering to each other are forcefully separated, the fixed toner images might be damaged. Such an adhering state of the stacked recording materials is referred to as blocking. To suppress blocking, a cooling device may be employed to cool a recording material after a toner image is fixed on the recording material under heat.

For example, a cooling device is proposed to absorb heat from a recording material with cooling members while sandwiching and conveying the recording material by conveyance belts. Alternatively, it is known that cooling the recording material alternately from both faces rather than a single face allows more efficient cooling performance (e.g., JP-2012-098677-A1).

In addition, another cooling device is proposed that has enhanced capabilities of correcting curling of a recording material and cooling the recording material (e.g., JP-2009-161347-A1).

BRIEF SUMMARY

In at least one exemplary embodiment of this disclosure, there is provided a recording-material cooling device including a first belt, a first cooling unit, and a second cooling unit. The first belt is disposed at a first face side of a recording material. The first cooling unit has a first heat absorbing surface to contact the first belt to absorb heat of the recording material. The second cooling unit has a second heat absorbing surface to directly or indirectly contact the recording material to absorb heat of the recording material. The second cooling unit is disposed at a second face side of the recording material. The first cooling unit and the second cooling unit are offset from each other in a transport direction of the recording material. Each of the first heat absorbing surface of the first cooling unit and the second heat absorbing surface of the second cooling unit has a shape in which an inner area protrudes beyond opposed ends in the transport direction of the recording material. The first heat absorbing surface and the second heat absorbing surface overlap each other in a direction crossing the transport direction of the recording material.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
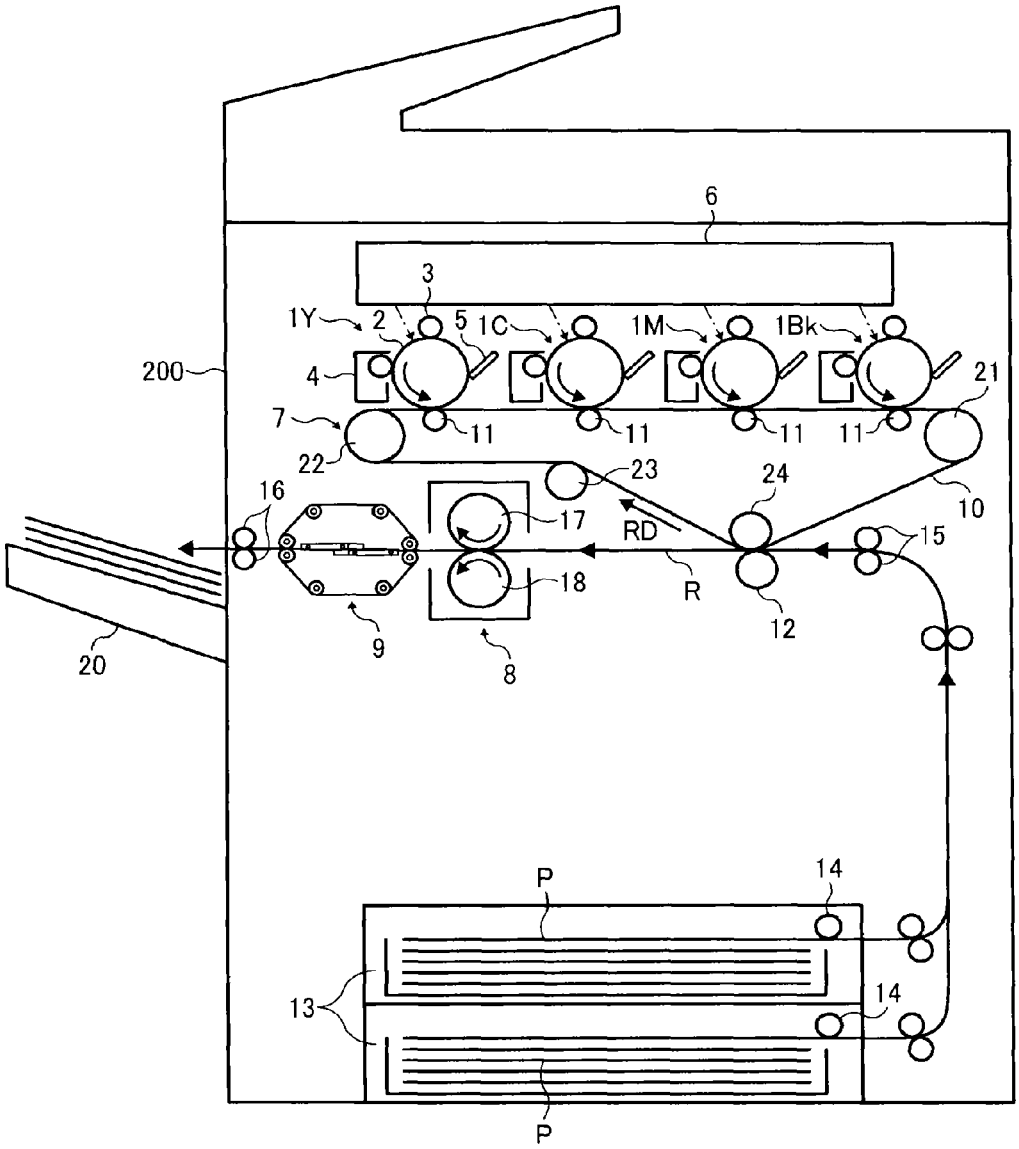
FIG. 1 is a schematic view of an image forming apparatus according to exemplary embodiments of this disclosure.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION OF EXEMPLARY EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the exemplary embodiments are described with technical limitations with reference to the attached drawings, such description is not intended to limit the scope of the disclosure and all of the components or elements described in the exemplary embodiments of this disclosure are not necessarily indispensable.

Referring now to the drawings, exemplary embodiments of the present disclosure are described below. In the drawings for explaining the following exemplary embodiments, the same reference codes are allocated to elements (members or components) having the same function or shape and redundant descriptions thereof are omitted below.

FIG. 1 is a schematic view of an image forming apparatus according to exemplary embodiments of this disclosure.

The image forming apparatus illustrated in FIG. 1 includes a tandem-type image forming section in which four process units 1Y, 1C, 1M, and 1Bk serving as image forming units are arranged in tandem. The process units 1Y, 1C, 1M, and 1Bk are removably mountable relative to an apparatus body 200 of the image forming apparatus and have substantially the same configuration except for containing different color toners of yellow (Y), cyan (C), magenta (M), and black (Bk) corresponding to color separation components of a color image.

Specifically, each of the process units 1Y, 1C, 1M, and 1Bk includes, e.g., a photoreceptor 2, a charging roller 3, a developing device 4, and a cleaning blade 5. The photoreceptor 2 has, e.g., a drum shape and serves as a latent image carrier. The charging roller 3 serves as a charging device to charge a surface of the photoreceptor 2. The developing device 4 forms a toner image on the surface of the photoreceptor 2. The cleaning blade 5 serves as a cleaner to clean the surface of the photoreceptor 2. In FIG. 1, the photoreceptor 2, the charging roller 3, the developing device 4, and the cleaning blade 5 of the process unit 1Y for yellow are represented by the photoreceptor 2Y, the charging roller 3Y, the developing device 4Y, and the cleaning blade 5Y, respectively. Regarding the other process units 1C, 1M, and 1Bk, color index are omitted for simplicity.

In FIG. 1, above the process units 1Y, 1C, 1M, and 1Bk, an exposing device 6 is disposed to expose the surface of the photoreceptor 2. The exposing device 6 includes, e.g., a light source, polygon mirrors, f-lenses, and reflection lenses to irradiate a laser beam onto the surface of the photoreceptor 2.

A transfer device 7 is disposed below the process units 1Y, 1C, 1M, and 1Bk. The transfer device 7 includes an intermediate transfer belt 10 formed of an endless belt serving as a transfer body. The intermediate transfer belt 10 is wound around a plurality of rollers 21 to 24 serving as support members. One of the rollers 21 to 24 is rotated as a driving roller to circulate the intermediate (rotate) transfer belt 10 in a direction indicated by an arrow RD in FIG. 1.

Four primary transfer rollers 11 serving as primary transfer devices are disposed at positions at which the primary transfer rollers 11 oppose the respective photoreceptors 2. At the respective positions, the primary transfer rollers 11 are pressed against an inner circumferential surface of the intermediate transfer belt 10. Thus, primary transfer nips are formed at positions at which the photoreceptors 2 contact pressed portions of the intermediate transfer belt 10. Each of the primary transfer rollers 11 is connected to a power source, and a predetermined direct current (DC) voltage and/or an alternating current (AC) voltage are supplied to the primary transfer rollers 11.

A secondary transfer roller 12 serving as a second transfer device is disposed at a position at which the secondary transfer roller 12 opposes the roller 24, which is one of the rollers around which the intermediate transfer belt 10 is wound. The secondary transfer roller 12 is pressed against an outer circumferential surface of the intermediate transfer belt 10. Thus, a secondary transfer nip is formed at a position at which the secondary transfer roller 12 and the intermediate transfer belt 10 contact each other. Like the primary transfer rollers 11, the secondary transfer roller 12 is connected to a power source, and a predetermined direct current (DC) voltage and/or an alternating current (AC) voltage are supplied to the secondary transfer roller 12.

Below the apparatus body 200 is a plurality of feed trays 13 to store sheet-type recording materials P, such as a sheet of paper or overhead projector (OHP) sheet. Each feed tray 13 is provided with a feed roller 14 to feed the recording materials P stored. An output tray 20 is mounted on an outer surface of the apparatus body 200 at the left side in FIG. 1 to stack recording materials P discharged to an outside of the apparatus body 200.

The apparatus body 200 includes a transport path R to transport a recording material P from the feed trays 13 to the output tray 20 through the secondary transfer nip. On the transport path R, registration rollers 15 are disposed upstream from the secondary transfer roller 12 in a transport direction of a recording material (hereinafter, recording-material transport direction). A fixing device 8, a cooling device 9, and paired output rollers 16 are disposed in turn at positions downstream from the secondary transfer roller 12 in the recording-material transport direction. The fixing device 8 includes a fixing roller 17 and a pressing roller 18. The fixing roller serves as a fixing member including an internal heater. The pressing roller 18 serves as a pressing member to press the fixing roller 17. A fixing nip is formed at a position at which the fixing roller 17 and the pressing roller 18 contact each other.

Next, a basic operation of the image forming apparatus is described with reference to FIG. 1.

When imaging operation is started, the photoreceptor 2 of each of the process units 1Y, 1C, 1M, and 1Bk is rotated counterclockwise in FIG. 1, and the charging roller 3 uniformly charges the surface of the photoreceptor 2 with a predetermined polarity. Based on image information of a document read by a reading device, the exposing device 6 irradiates laser light onto the charged surface of the photoreceptor 2 to form an electrostatic latent image on the surface of the photoreceptor 2. At this time, image information exposed to each photoreceptor 2 is single-color image information obtained by separating a desired full-color image into single-color information on yellow, cyan, magenta, and black. Each developing device 4 supplies toner onto the electrostatic latent image formed on the photoreceptor 2, thus making the electrostatic latent images a visible image as a toner image.

One of the rollers 21 to 24 around which the intermediate transfer belt 10 is wound is driven for rotation to circulate the intermediate transfer belt 10 in the direction RD in FIG. 1. A voltage having a polarity opposite a charged polarity of toner and subjected to constant voltage or current control is supplied to each of the primary transfer rollers 11. As a result, a transfer electric field is formed at the primary transfer nip between each primary transfer roller 11 and the opposing photoreceptor 2. Toner images of respective colors on the photoreceptors 2 are transferred one on another onto the intermediate transfer belt 10 by the transfer electric fields formed at the primary transfer nips. Thus, the intermediate transfer belt 10 bears a full-color toner image on the surface of the intermediate transfer belt 10. Residual toner remaining on each photoreceptor 2 without being transferred onto the intermediate transfer belt 10 is removed with the cleaning blade 5.

With rotation of the feed roller 14, a recording material P is fed from the corresponding feed tray 13. The recording material P is further sent to the secondary transfer nip between the secondary transfer roller 12 and the intermediate transfer belt 10 by the registration rollers 15 so as to synchronize with the full-color toner image on the intermediate transfer belt 10. At this time, a transfer voltage of the polarity opposite the charged polarity of toner of the toner image on the intermediate transfer belt 10 is supplied to the secondary transfer roller 12. As a result, a transfer electric field is formed at the secondary transfer nip. By the transfer electric field formed at the secondary transfer nip, the toner image on the intermediate transfer belt 10 is collectively transferred onto the recording material P. Then, the recording material P is sent into the fixing device 8, and the fixing roller 17 and the pressing roller 18 apply heat and pressure to fix the toner image on the recording material P. After the recording material P is cooled with the cooling device 9, the paired output rollers 16 output the recording material P onto the output tray 20.

The above description relates to image forming operation for forming a full color image on a recording material. In other image forming operation, a single color image can be formed by any one of the process units 1Y, 1M, 1C, and 1Bk, or a composite color image of two or three colors can be formed by two or three of the process units 1Y, 1M, 1C, and 1Bk.

Figure 2:
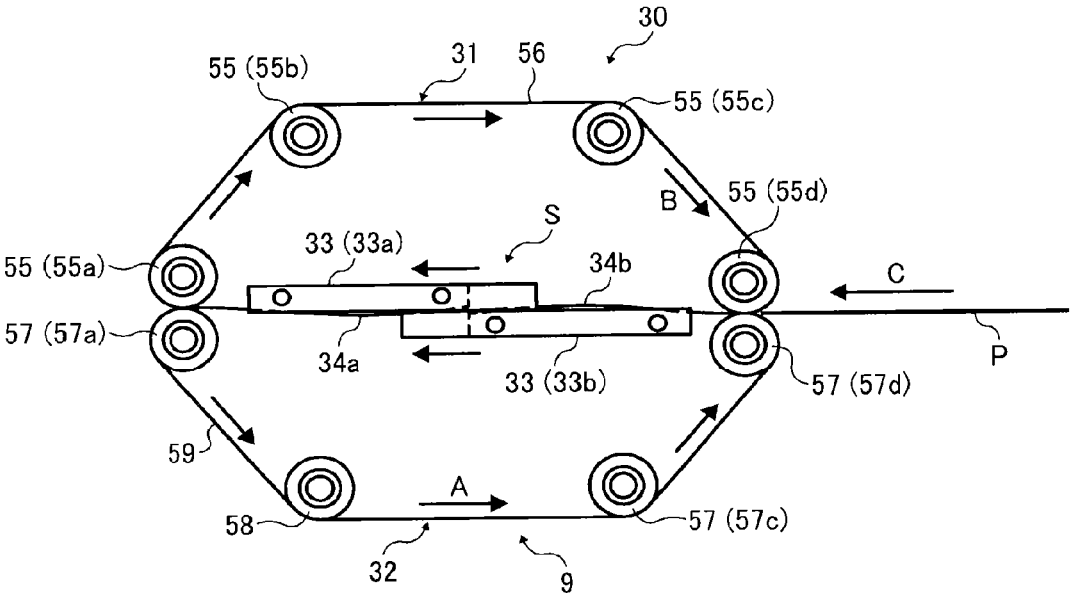
FIG. 2 is a side view of a cooling device disposed in the image forming apparatus illustrated in FIG. 1 according to an exemplary embodiment of this disclosure.

As illustrated in FIG. 2, the cooling device 9 has a cooling member 33 to cool a sheet-type recording material P conveyed by traveling of belts of a belt transport unit 30. The belt transport unit 30 includes a first transport assembly 31 and a second transport assembly 32. The first transport assembly 31 is disposed at one face side (front face side or upper face side) of the sheet-type recording material P. The second transport assembly 32 is disposed at the other face side (back face side or lower face side) of the sheet-type recording material P. The belt transport unit 30 also includes a pair of the cooling members 33*a* and 33*b*. The cooling member 33*a* serving as a first cooling unit is disposed at one face side (front face side or upper face side) of the sheet-type recording material P. The cooling member 33*b* serving as a second cooling unit is disposed at the other face side (back face side or lower face side) of the sheet-type recording material P.

Figure 3:
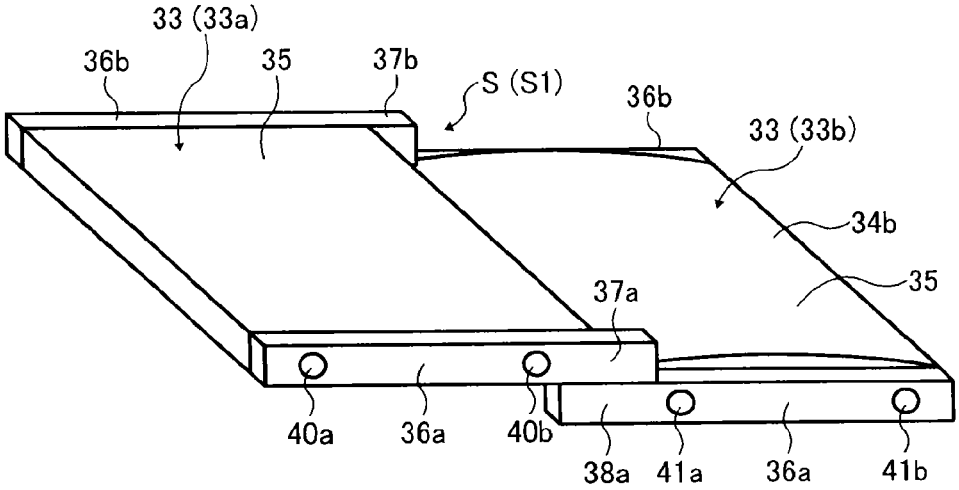
FIG. 3 is a perspective view of cooling members of the cooling device illustrated in FIG. 2.
Figure 4:
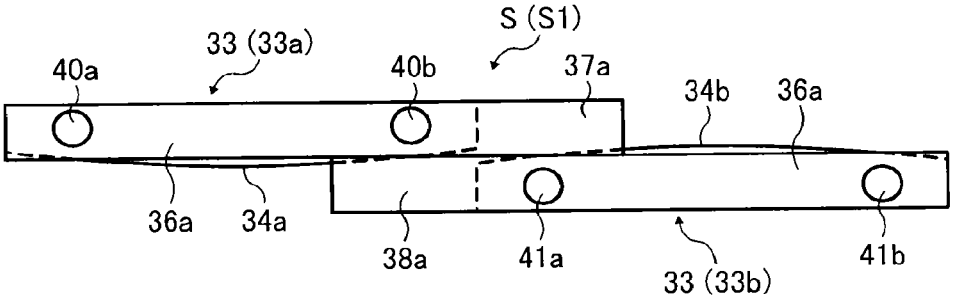
FIG. 4 is a side view of the cooling members of the cooling device illustrated in FIG. 2.

As illustrated in FIGS. 3 and 4, each of the cooling members 33 includes a cooling body 35 of a rectangular flat-plate shape and lateral edges 36*a* and 36*b* disposed at lateral faces of the cooling body 35. The lateral edges 36*a* and 36*b* of the cooling member 33*a* have contact portions 37*a* and 37*b*, respectively. The contact portions 37*a* and 37*b* protrude toward an upstream side beyond an upstream edge of the cooling body 35 in a recording-material transport direction indicated by an arrow C in FIG. 2. The lateral edges 36*a* and 36*b* of the cooling member 33*b* include contact portions 38*a* protruding toward a downstream side beyond a downstream edge of the cooling body 35 in the recording-material transport direction C.

In such a case, in a state in which the contact portions 37*a* and 37*b* of the cooling member 33*a* are in contact with the contact portions 38*a*, respectively, of the cooling member 33*b*, the contact portions 37*a* and 37*b* overlap the contact portions 38*a*, so that the cooling member 33*a* and the cooling member 33*b* are offset from each other in the transport direction of the sheet-type recording material. The place of overlap is designated as S, or S1. The cooling body 35 of the cooling member 33*a* has, as a lower surface, a heat absorbing surface 34*a* of an arc surface shape slightly protruding downward. The cooling body 35 of the cooling member 33*b* has a heat absorbing surface 34*b* of an arc surface shape slightly protruding upward.

Each of the cooling members 33*a* and 33*b* includes a cooling liquid channel through which cooling liquid flows. The contact portions 38*a* disposed at a rear side of the cooling device have openings 40*a*, 40*b*, 41*a*, and 41*b* of circulation channels.

Figure 5:
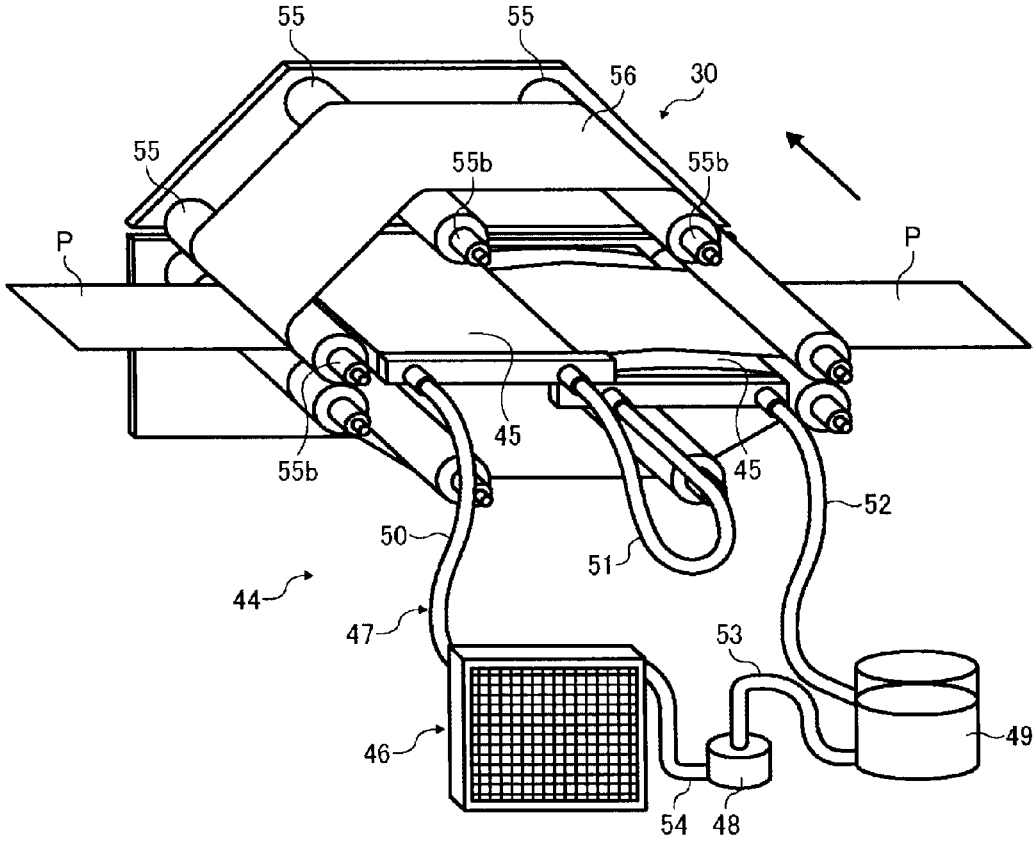
FIG. 5 is a perspective view of the cooling device illustrated in FIG. 2 seen from a rear side thereof.

In other words, as illustrated in FIG. 5, the cooling device 9 has a cooling-liquid circuit 44. The cooling-liquid circuit 44 includes a heat receiving part 45 to receive heat from a recording material P serving as a heat generating part, a heat dissipating part 46 to radiate heat of the heat receiving part 45, and a circulation channel 47 to circulate cooling liquid through the heat receiving part 45 and the heat dissipating part 46. The circulation channel 47 includes a pump 48 to circulate cooling liquid and a liquid tank 49 to store cooling liquid, thus causing the cooling members 33*a* and 33*b* to function as the heat receiving part 45. The heat dissipating part 46 includes, e.g., a radiator. The cooling liquid is, for example, magnetic fluid. The magnetic fluid includes, e.g., water, hydrocarbon oil, or fluorine oil as medium and ferromagnetic ultrafine particles, such as high concentration of magnetite, dispersed in stable state in the medium. Additionally, surface-active agent is chemically attached to surfaces of the ferromagnetic ultrafine particles.

The circulation channel 47 includes pipes 50 to 54. The pipe 50 connects the opening 40*a* of the cooling member 33*a* to the heat dissipating part 46 (e.g., radiator). The pipe 51 connects the opening 40*b* of the cooling member 33*a* to the opening 41*a* of the cooling member 33*b*. The pipe 52 connects the opening 41*b* of the cooling member 33*b* to the liquid tank 49. The pipe 53 connects the liquid tank 49 to the pump 48. The pipe 54 connects the pump 48 to the heat dissipating part 46.

The first transport assembly 31 includes a plurality of rollers 55 and a belt (conveyance belt) 56 wound around the plurality of rollers 55. The second transport assembly 32 includes a plurality of rollers 57, a single roller (driving roller) 58, and a belt (conveyance belt) 59 wound around the plurality of rollers 57 and the driving roller 58.

Accordingly, a recording material P is sandwiched and conveyed by the belt 56 of the first transport assembly 31 and the belt 59 of the second transport assembly 32. In other words, as illustrated in FIG. 2, the belt 59 is traveled in a direction indicated by an arrow A by a driving unit. With travel of the belt 59, the belt 56 of the first transport assembly 31 is traveled in a direction indicated by an arrow B via the recording material P sandwiched between the belts 56 and 59. Thus, the recording material P is conveyed from an upstream side to a downstream side in the transport direction indicated by the arrow C in FIG. 2.

For the first transport assembly 31 and the second transport assembly 32, as illustrated in FIGS. 3 and 4, the contact portions 37*a* and 37*b* of the cooling member 33*a* are in contact with the contact portions 38*a*, respectively, of the cooling member 33*b*. In such a state, as illustrated in, e.g., FIG. 2, the cooling member 33*a* and the cooling member 33*b* are offset from each other in the transport direction C of the sheet-type recording material. Thus, the contact portions 37*a* and 37*b* and the contact portions 38*a* position the recording material P with respect to a thickness direction of the recording material P (hereinafter, the recording-material thickness direction).

With respect to the recording-material transport direction, the cooling member 33*a* and the cooling member 33*b* are positioned by side plates.

As described above, the cooling device 9 has a first positioning unit S1. The first positioning unit S1 defines relative positions of the first transport assembly 31 and the second transport assembly 32 with respect to the recording-material thickness direction. As described above, the first positioning unit S1 in the recording-material thickness direction performs positioning with the contact portions 37*a* and 37*b* of the cooling member 33*a* and the contact portions 38*a* of the cooling member 33*b*. It is to be noted that, the configuration of the first positioning unit S1 is not limited to the above-described configuration and, for example, the contact portions 37*a*, 37*b*, and 38*a*, may be integrally molded with the apparatus body 200.

Next, operation of the cooling device having the above-described configuration is described below. When the recording material P is sandwiched and conveyed by the belts 56 and 59, as illustrated in, e.g., FIG. 2, the first transport assembly 31 and the second transport assembly 32 are placed adjacent to each other. In a state illustrated in FIG. 2, if the driving roller 58 of the second transport assembly 32 is rotated, as described above, the belts 56 and 59 travel in the directions indicated by the arrows A and B, respectively, to transport the recording material P in the transport direction indicated by the arrow C. In such a state, cooling liquid is circulated in the cooling-liquid circuit 44. In other words, the pump 48 is activated to flow the cooling liquid through the cooling liquid channels of the cooling members 33*a* and 33*b*.

At this time, an inner surface of the belt 56 of the first transport assembly 31 slides over the heat absorbing surface 34*a* of the cooling member 33*a*, and an inner surface of the belt 59 of the second transport assembly 32 slides over the heat absorbing surface 34*b* of the cooling member 33*b*. From a front surface (upper surface) side of the recording material P, the cooling member 33*a* absorbs heat of the recording material P via the belt 56. From a back surface (lower surface) side of the recording material P, the cooling member 33*b* absorbs heat of the recording material P via the belt 59. In such a case, an amount of heat absorbed by the cooling members 33*a* and 33*b* is transported to the outside by the cooling liquid, thus maintaining the cooling members 33*a* and 33*b* at relatively low temperature.

In other words, by driving the pump 48, the cooling liquid is circulated through the cooling-liquid circuit 44. The cooling liquid flows through the cooling-liquid channels of the cooling members 33*a* and 33*b*, absorbs heat of the cooling members 33*a* and 33*b*, and turns into a relatively high temperature. The cooling liquid at high temperature passes through the heat receiving part 45 (e.g., radiator), and heat of the cooling liquid is radiated to outside air, thus reducing the temperature of the cooling liquid. The cooling liquid at relatively low temperature flows through the cooling-liquid channels again, and the cooling members 33*a* and 33*b* act as the heat dissipating part 46. By repeating the above-described cycle, the recording material P is cooled from both sides thereof.

With such a configuration, the cooling device 9 cools recording materials P to prevent the recording materials P from being stacked on the output tray 20 at high temperature. As a result, the cooling device 9 effectively prevents blocking, thus allowing the recording materials P to be stacked on the output tray 20 without adhering to each other.

Figure 6A:
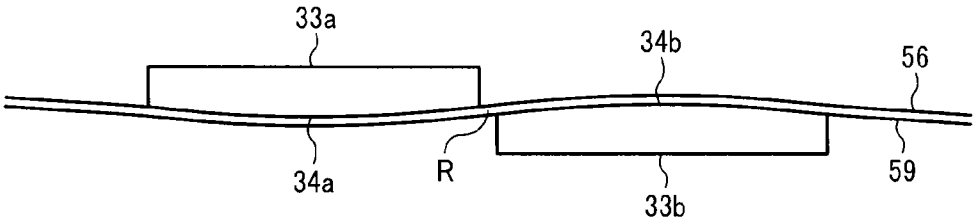
FIG. 6A is a schematic view of conveyance belts and cooling members in contact state according to an exemplary embodiment of this disclosure.
Figure 6B:
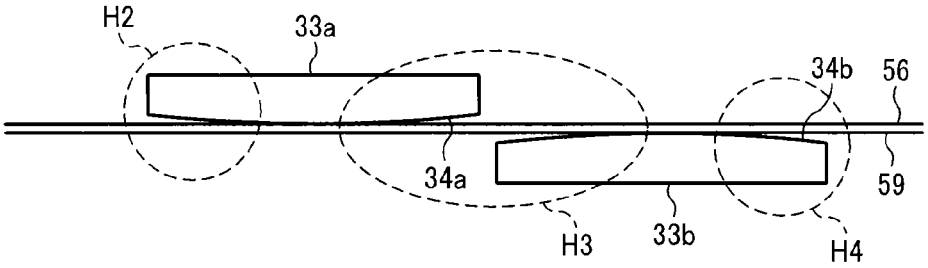
FIG. 6B is a schematic view of conveyance belts and cooling members according to a comparative example.

FIG. 6A is a schematic view of conveyance belts 56 and 59 and cooling members 33*a* and 33*b* in a contact state according to an exemplary embodiment of this disclosure. FIG. 6B is a schematic view of conveyance belts 56 and 59 and cooling members 33*a* and 33*b* according to a comparative example.

In FIG. 6A, heat absorbing surfaces 34*a* and 34*b* of the cooling members 33*a* and 33*b* are arc surfaces (of a shape in which a middle portion protrudes beyond end portions thereof). Each of the heat absorbing surfaces 34*a* and 34*b* is formed along the transport path R. Additionally, the cooling members 33*a* and 33*b* are offset from each other in both the thickness direction and the transport direction of the recording material P. By contrast, for example, if flat-shaped cooling members are employed, upstream and downstream end portions of the cooling members in a belt conveyance direction rub against each other, thus imposing burden to the belts. Hence, in exemplary embodiments of the disclosure, the heat absorbing surfaces 34*a* and 34*b* are formed as arc surfaces, thus reducing the burden to the belts 56 and 59.

In the comparative example illustrated in FIG. 6B, the cooling members 33*a* and 33*b* do not overlap each other in the recording-material thickness direction. In such a case, since the absorbing surface 34*a* of the cooling member 33*a* and the heat absorbing surface 34*b* of the cooling member 33*b* are arc surfaces, the belts 56 and 59 do not contact the cooling members 33*a* and 33*b* at portions H2, H3, and H4 in FIG. 6B. Such a configuration may not effectively absorb heat of the recording material P.

By contrast, in the configuration illustrated in FIG. 6A, the cooling members 33*a* and 33*b* overlap each other in the recording-material thickness direction. The heat absorbing surface 34*b* is disposed upper than upper surfaces of the rollers 57*a* and 57*d*. The heat absorbing surface 34*a* is disposed lower than lower surfaces of the rollers 55*a* and 55*d*. As a result, the belt 59 is raised from an outer circumference of the roller 57*d* toward the heat absorbing surface 34*b*, bent upward and downward along the heat absorbing surface 34*b*, bent downward and upward along the heat absorbing surface 34*a*, and bent around an outer circumference of the roller 57*a*. On the other hand, the belt 56 is raised from an outer circumference of the roller 55*d* toward the heat absorbing surface 34*b*, bent upward and downward along the heat absorbing surface 34*b*, bent downward and upward along the heat absorbing surface 34*a*, and bent around an outer circumference of the roller 55*a*.

Such a configuration increases the contact areas in which the belts 56 and 59 contact the heat absorbing surfaces 34*a* and 34*b*, thus more effectively absorbing heat of the recording material P than the configuration illustrated in FIG. 6B.

Figure 7A:
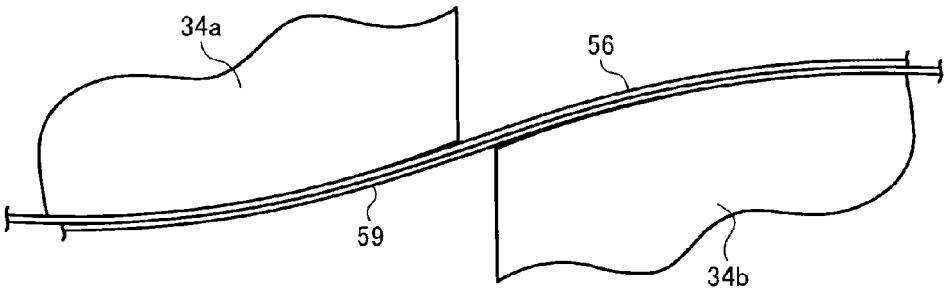
FIG. 7A is an enlarged view of relative positions of belts and cooling members according to an exemplary embodiment of this disclosure.
Figure 7B:
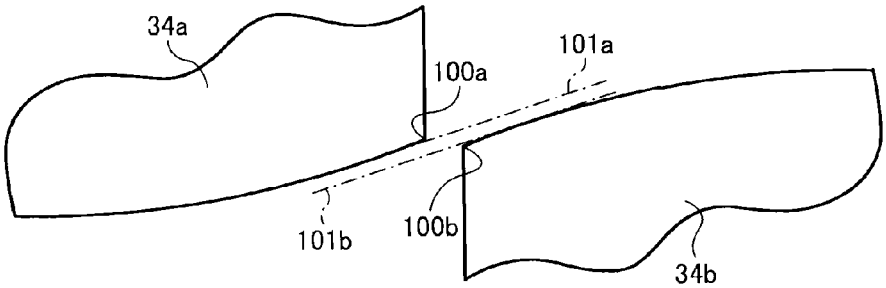
FIG. 7B is an enlarged view of guided directions of the belts illustrated in FIG. 7A.

FIGS. 7A and 7B are schematic views of belts 56 and 59 and cooling members 33*a* and 33*b* according to an exemplary embodiment of this disclosure.

In FIGS. 7A and 7B, as illustrated in FIG. 6A, relative positions between the belts 56 and 59 and the cooling members 34*a* and 34*b* are shown as enlarged views. In other words, FIG. 7A is an enlarged view of relative positions of the belts 56 and 59 and end portions of the heat absorbing surfaces 34*a* and 34*b*. FIG. 7B is an enlarged view of guided directions of the belts 56 and 59 illustrated in FIG. 7A. For example, for the configuration illustrated in FIG. 6A in which the cooling members 33*a* and 33*b* are arranged to overlap each other in the recording-material thickness direction, the belts 56 and 59 preferably contact edges of the cooling members 33*a* and 33*b*. However, if the belts 56 and 59 wind around the edges of the cooling members 33*a* and 33*b*, large pressure might be applied to the belts 56 and 59 or a sheet-shaped recording material P, thus accelerating deterioration of the belts 56 and 59.

Hence, as illustrated in FIG. 7B, a heat absorbing surface 34*a* and a heat absorbing surface 34*b* are arranged so that a tangent line (first tangent line) 101*a* to an edge 100*a* of the heat absorbing surface 34*a* (i.e., first tangent line to an edge of a contact surface of the first cooling member (cooling member 33*a*) to contact the belt 56) is in parallel to a tangent line 101*b* to an edge 100*b* of the heat absorbing surface 34*b* (i.e., second tangent line to an edge of a contact surface of the second cooling member (cooling member 33*b*) to contact the belt 59),i.e., the direction of the tangent line 101*a* is the same as the direction of the tangent line 101*b*. As a result, the belts 56 and 59 contact the edges 100*a* and 100*b* of the heat absorbing surfaces 34*a* and 34*b*, respectively, and the degree of concentration of pressure is relatively low on the edges 100*a* and 100*b* of the heat absorbing surfaces 34*a* and 34*b*. Such a configuration increases the distances (areas) at which the belts 56 and 59 contact the heat absorbing surfaces 34*a* and 34*b*, respectively, thus reducing the burden to the belts 56 and 59 while maintaining high cooling efficiency.

Figure 8:
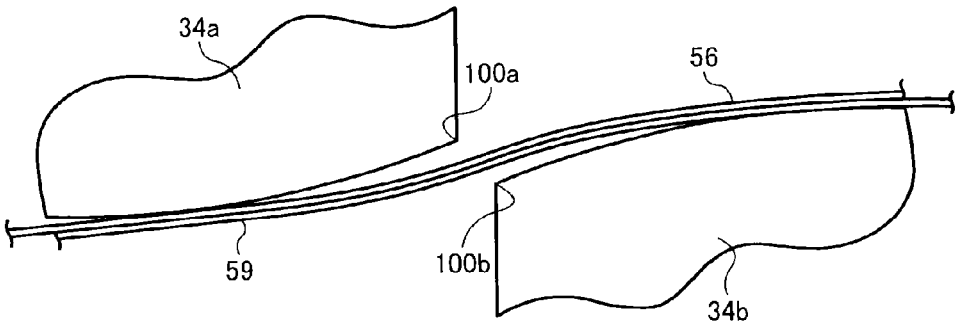
FIG. 8 is an enlarged view of belts and cooling members according to an exemplary embodiment of this disclosure.

FIG. 8 is an enlarged view of belts 56 and 59 and cooling members 34*a* and 34*b* according to an exemplary embodiment of this disclosure.

The arrangement of FIG. 8 differs from the arrangement of FIGS. 7A and 7B in that edges 100*a* and 100*b* of heat absorbing surfaces 34*a* and 34*b* are separated from the belts 56 and 59. The arrangement of FIG. 8 is the same as the arrangement of FIGS. 7A and 7B in the other points, and therefore, the same reference codes are allocated to the same components, and redundant descriptions thereof are omitted (which is the same in the following examples).

For the arrangement of FIG. 8, the belts 56 and 59 contact end portions of the heat absorbing surfaces 34*a* and 34*b*, respectively, at inner positions within the widths of the heat absorbing surfaces 34*a* and 34*b*, unlike the edges 100*a* and 100*b* illustrated in FIGS. 7A and 7B. Like the arrangement of FIGS. 7A and 7B, tangent lines to the edge portions are the same between the belts 56 and 59. The tangent lines are separated from the edges 100*a* and 100*b* of the heat absorbing surfaces 34*a* and 34*b*. Thus, the belts 56 and 59 are not in contact with the edges 100*a* and 100*b* of the heat absorbing surface 34*a* and 34*b*, respectively.

Figure 9A:
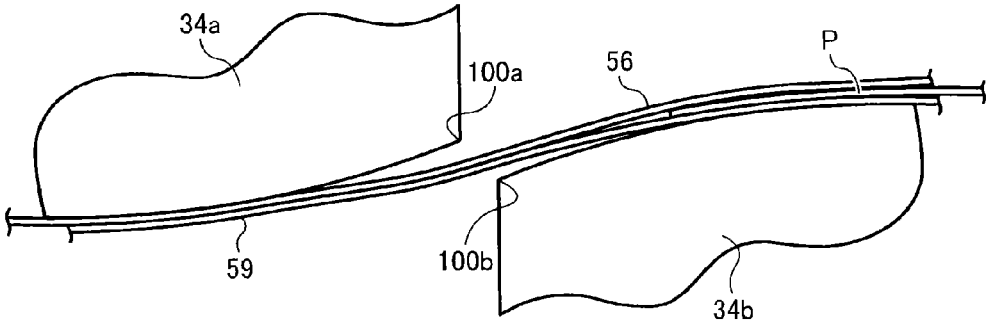
FIGS. 9A to 9C are schematic views of displacement states of the belts when a recording material is transported to between the belts from a state illustrated in FIG. 8.
Figure 9B:
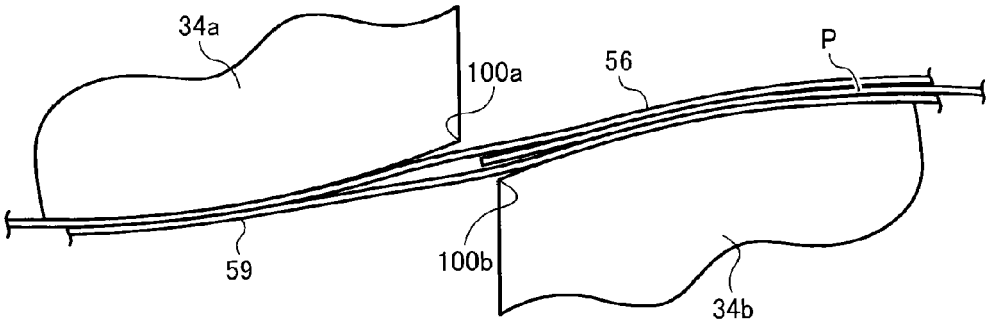
Figure 9C:
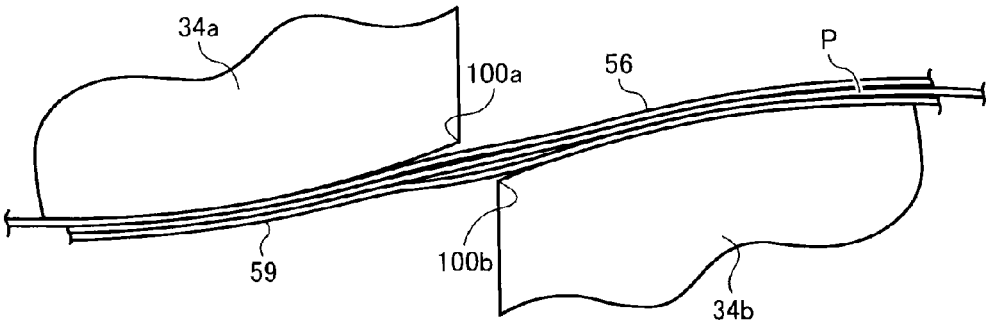

FIGS. 9A to 9C are schematic views of displacement states of the belts 56 and 59 when a recording material P is transported to between the belts 56 and 59 from a state illustrated in FIG. 8.

When the recording material P is moved toward the heat absorbing surface 34*b* from the state of FIG. 8 before a recording material P is transported, as illustrated in FIG. 9A, the belts 56 and 59 are spread by the recording material P. When the recording material P approaches the edge 100*b* of the heat absorbing surface 34*b*, as illustrated in FIG. 9B, the belt 59 contacts the edge 100*b* or is further spread so as to form a slight clearance. When the recording material P is further moved toward the heat absorbing surface 34*a*, as illustrated in FIG. 9C, the belt 56 contacts the edge 100*a* or is further spread so as to form a slight clearance. Thus, the recording material P is transported.

For such a configuration, when the recording material P do not pass, the belts 56 and 59 do not contact the edges 100*a* and 100*b* and their nearby portions of the cooling members 33*a* and 33*b*. By contrast, when the recording material P passes between the belts 56 and 59, the contact areas between the belts 56 and 59 and the heat absorbing surfaces 34*a* and 34*b*, respectively, are increased by the thickness of the recording material. Thus, the burden to the belts 56 and 59 can be reduced. When the recording material passes, the contact areas between the belts 56 and 59 and the heat absorbing surfaces 34*a* and 34*b*, respectively, are increased, thus maintaining high cooling efficiency.

Figure 10:
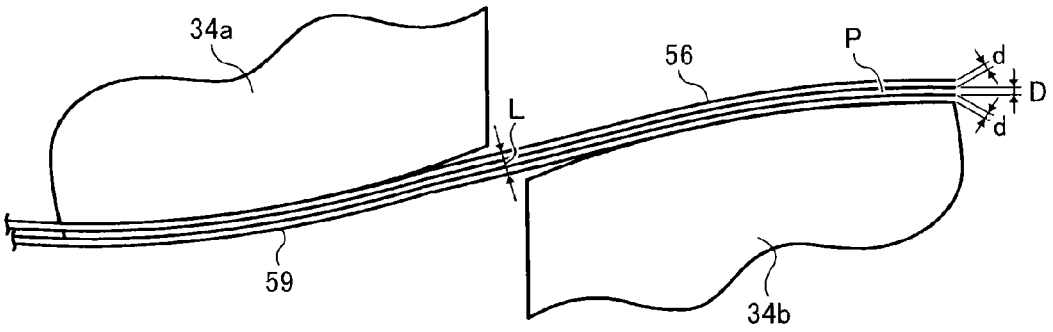
FIG. 10 is an enlarged view of relative positions of belts and heat absorbing surfaces according to an exemplary embodiment of this disclosure.

FIG. 10 is an enlarged view of relative positions between cooling members 33*a* and 33*b* and belts 56 and 59 in a variation of the above-described exemplary embodiment illustrated in FIG. 8.

The thicker a recording material P, the greater the amount of heat accumulated in the recording material P. Hence, in the variation illustrated in FIG. 10, when the recording material P is conveyed, the contact area between the belt 56 (or 59) and a heat absorbing surface 34*a* (or 34*b*) has a maximum value. Accordingly, the belts 56 and 59 are arranged so that a tangent line to an end portion of the heat absorbing surface 34*b* is placed away from a tangent line to an end portion of the heat absorbing surface 34*a* by a distance L. Here, a relation of L=2d+D is satisfied, where d represents the thickness of each of the belts 56 and 59 and D represents the thickness of a thickest one of usable recording materials P.

For such a configuration, when a recording material P does not pass between the belts 56 and 59, the belts 56 and 59 do not contact the edges 100*a* and 100*b* and their nearby portions of the heat absorbing surfaces 34*a* and 34*b*, respectively. By contrast, when the thickest recording material P passes between the heat absorbing surfaces 34*a* and 34*b*, the belts 56 and 59 contact the edges 100*a* and 100*b* and/or their nearby portions by the thickness of the recording material P. Such a configuration reduces the burden to the belts 56 and 59. As described above, when the thickest recording material P passes, the belts 56 and 59 contact the edges 100*a* and 100*b* and/or their nearby portions of the heat absorbing surfaces 34*a* and 34*b*, thus maintaining high cooling efficiency.

In the above-described exemplary embodiments of FIGS. 7A to 7C, FIG. 8, and FIG. 10, in a state in which the recording material P is not transported, the edges 100*a* and 100*b* are separated from the belts 56 and 59 to reduce burden to the belts 56 and 59. In a configuration illustrated in FIG. 11, an edge surface 34*a*2 of a cooling member 33*a* has a shape different from that of any of the above-described embodiments to reduce burden to a belt 56.

Figure 11:
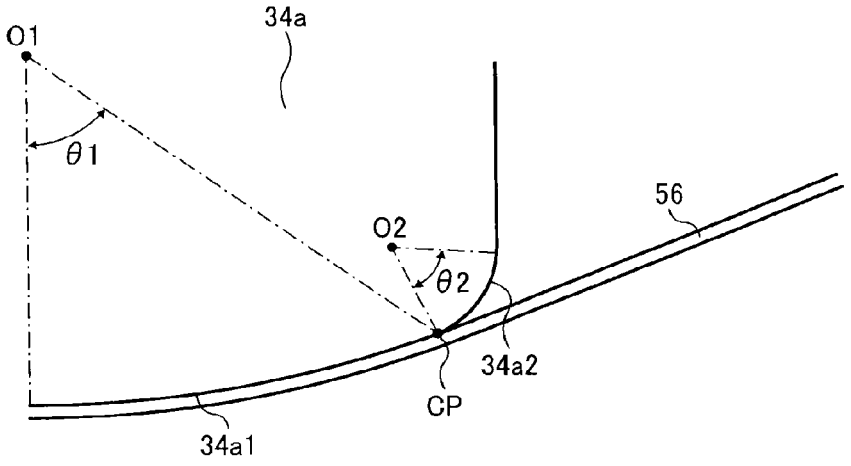
FIG. 11 is an enlarged view of a belt and an end portion of a heat absorbing surface according to an exemplary embodiment of this disclosure.

FIG. 11 is an enlarged view of the belt 56 and an end portion of the heat absorbing surface 34*a* according to an exemplary embodiment.

A heat absorbing surface 34*b* in this exemplary embodiment has a similar configuration, and therefore redundant descriptions thereof are omitted below. In this exemplary embodiment, the cooling member 33*a* is different from any of the above-described embodiments in shapes of the heat absorbing surface 34*a* and the end portion thereof. For example, as illustrated in FIG. 11, a first surface 34*a*1 serving as a contact portion to contact the belt 56 has an angle θ1 with respect to an imaginary center O1 and the edge surface 34*a*2 not contacting the belt 56 has an angle θ2 (θ1≠θ2) with respect to an imaginary center O2. In such a case, a tangent line drawn (from the first surface 34*a*1 side) to a changing point CP between the first surface 34*a*1 and the edge surface 34*a*2 as the end portion of the heat absorbing surface 34*a* has the same direction as a tangent line to an end portion of the heat absorbing surface 34*b*. Such a configuration reduces burden to the belt 56 with a simple structure. It is to be noted that, the configuration of this exemplary embodiment may be employed in combination of at least one of the above-described exemplary embodiments of FIGS. 7A to 7C, FIG. 8, and FIG. 10.

Figure 12:
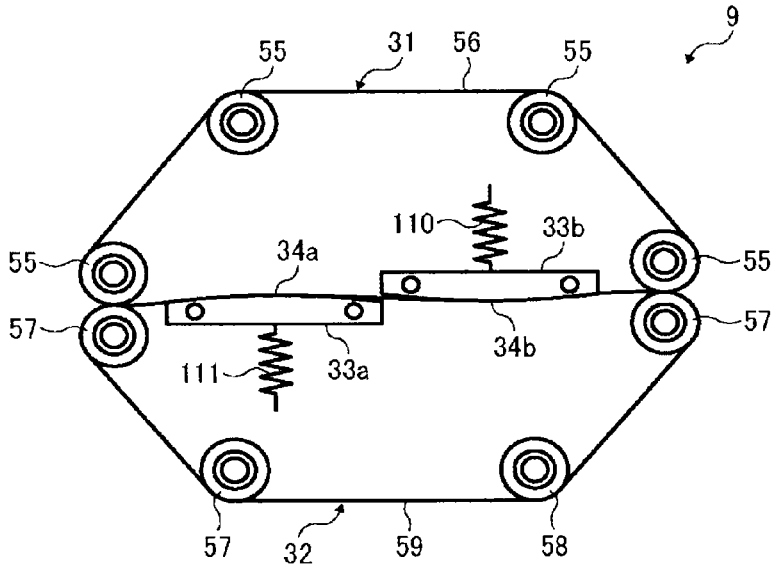
FIG. 12 is a side view of cooling members of a cooling device according to an exemplary embodiment of this disclosure.

For an exemplary embodiment illustrated in FIG. 12, elastic pressing members (e.g., springs) 110 and 111 press cooling members 33*a* and 33*b* toward belts 56 and 59, respectively. FIG. 12 is a schematic view of a cooling device 9 seen from a rear side of an image forming apparatus. In FIG. 12, a recording material P is transported from the left side to the right side.

In this exemplary embodiment, the cooling device 9 includes a first moving unit to move a first cooling unit in a direction crossing a transport direction of the recording material and a second moving unit to move a second cooling unit in a direction crossing the transport direction of the recording material. In such a case, the first moving unit includes the cooling member 33*a* serving as the first cooling unit, and the second moving unit includes the cooling member 33*b* serving as the second cooling unit. In other words, the cooling members 33*a* and 33*b* have guide portions to move up and down in a direction perpendicular to surfaces of belts 56 and 59 and restrict the rotation thereof. When the recording material P is not transported, the belts 56 and 59 and the heat absorbing surfaces 34*a* and 34*b* are placed in a state illustrated in FIG. 7A. When the recording material P is transported to the heat absorbing surfaces 34*a* and 34*b*, the cooling member 33*b* moves downward and the cooling member 33*a* moves upward. The total movement amount of the cooling members 33*a* and 33*b* is adjusted to be equal to the distance L illustrated in FIG. 10. Such a configuration reduces burden imposed from the end portions of the heat absorbing surfaces 34*a* and 34*b* to the belts 56 and 59.

Figure 13:
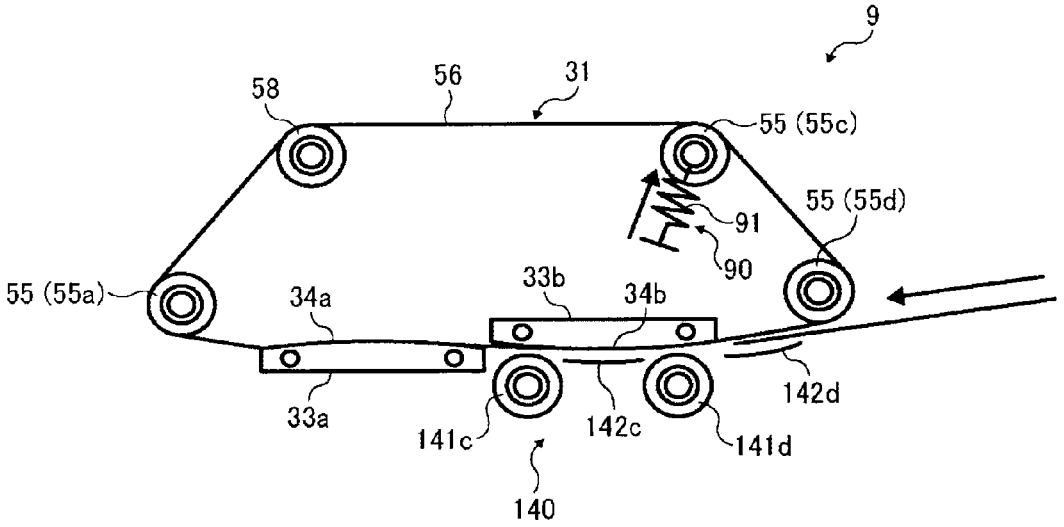
FIG. 13 is a side view of a cooling device according to an exemplary embodiment of this disclosure.

Exemplary embodiments of this disclosure are not limited to the configuration in which the belts are disposed so as to sandwich the transport path of a recording material in the recording-material thickness direction. In some embodiments, a cooling device includes a belt at only one side of the transport path in the recording-material thickness direction. FIG. 13 is a schematic view of a cooling device having such a configuration according to an exemplary embodiment of this disclosure. In this exemplary embodiment, as illustrated in FIG. 13, a guide roller assembly 140 is provided instead of the above-described lower conveyance unit 32. In other words, in such a case as well, the cooling device 9 includes two cooling members 33*a* and 33*b*. Rollers 141*c* and 141*d* are disposed below the cooling member 33*b*. A guide plate 142*c* is disposed between the rollers 141*c* and 141*d*. A guide plate 142*d* is disposed upstream from the roller 141*d*.

The guide plates 142*c* and 142*d* and the rollers 141*c* and 141*d* form the guide roller assembly 140.

In such a case, when a driving roller 58 is rotated, a belt 56 travels. The recording material P is guided by the guide plates 142*c* and 142*d* of the guide roller assembly 140 and the rollers 141*c* and 141*d*, and passes through the cooling device.

An upper surface of the recording material P contacts and is cooled by a heat absorbing surface 34*b*, i.e., a lower surface of the cooling member 33*b* via the belt 56. Then, a lower surface of the recording material P directly contacts and is cooled by a heat absorbing surface 34*a*, i.e., an upper surface of the cooling member 33*a*. The relative positions between the belt 56 and the cooling members 33*a* and 33*b* described in at least one of the above-described exemplary embodiments are also applicable in this exemplary embodiment.

For the cooling device 9 according to this exemplary embodiment, the guide roller assembly 140 serves as the lower transport unit (corresponding to the lower transport assembly 32) and thus allows downsizing of the image forming apparatus.

Figure 14:
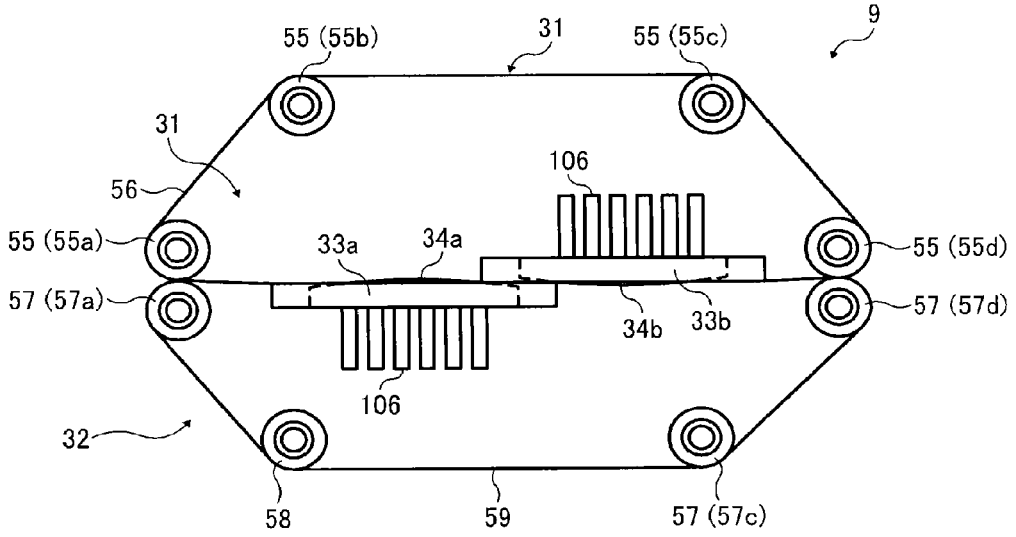
FIG. 14 is a side view of a cooling device according to an exemplary embodiment of this disclosure.

Exemplary embodiments of this disclosure are not limited to the cooling device employing the cooling-liquid circuit 44 in FIG. 5. For example, as illustrated in FIG. 14, a cooling device 9 according to an exemplary embodiment includes a radiation facilitating part 106. As the radiation facilitating part 106, for example, an air-cooling heat sink having multiple fins is employed. In such a case, the relative positions between the heat absorbing surfaces 34*a* and 34*b* and the belts 56 and 59 described in any of the above-described exemplary embodiments are also applicable in this exemplary embodiment.

As described above, use of the air-cooling heat sink obviates use of the cooling-liquid circuit 44, thus allowing downsizing and cost reduction of the apparatus.

Figure 15:
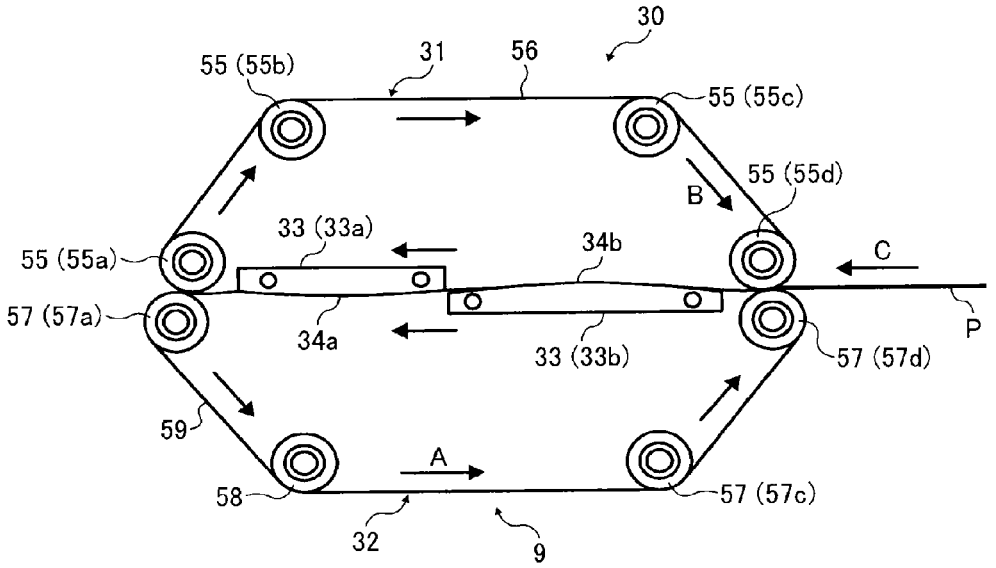
FIG. 15 is a side view of a cooling device according to an exemplary embodiment of this disclosure.

FIG. 15 is a side view of a cooling device 9 according to an exemplary embodiment of this disclosure.

As illustrated in FIG. 15, the cooling device 9 includes a belt transport unit 30 and cooling members 33 (33*a* and 33*b*) to cool a recording material P transported by traveling of belts 56 and 59 of the belt transport unit 30. The belt transport unit 30 includes a first transport assembly 31 and a second transport assembly 32. The first transport assembly 31 is disposed at one face side (front face side or upper face side) of the recording material P. The second transport assembly 32 is disposed at the other face side (back face side or lower face side) of the recording material P. The first transport assembly 31 has the belt 56 serving as belt member rotatably held by and stretched over a plurality of rollers 55*a* to 55*d*. The second transport assembly 32 has the belt 59 serving as belt member rotatably held by and stretched over a plurality of rollers 57*a*, 57*c*, 57*d*, and 58. The belt transport unit 30 also includes a pair of cooling members 33*a* and 33*b* disposed in contact with inner circumferential surfaces of the belts 56 and 59, respectively. The cooling member 33*a* is disposed at one face side (front face side or upper face side) of the recording material P. The cooling member 33*b* is disposed at the other face side (back face side or lower face side) of the recording material P.

Figure 16:
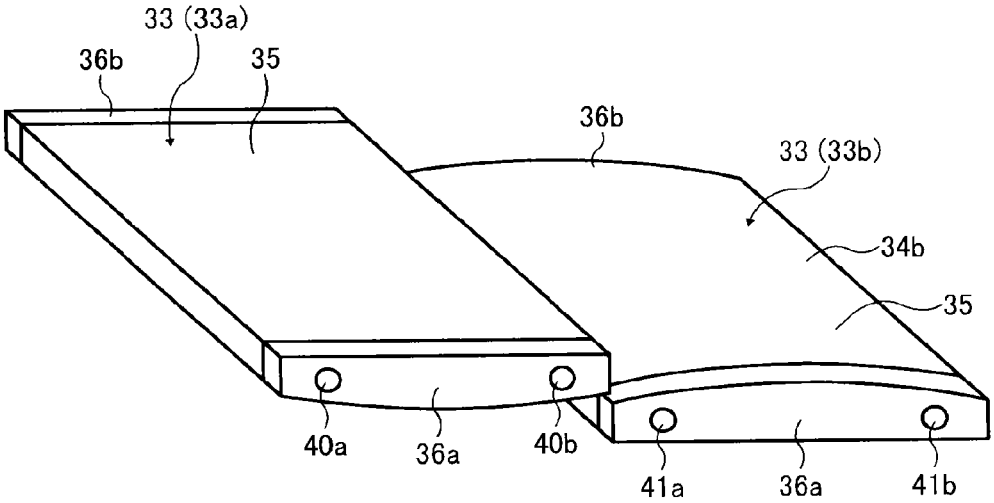
FIG. 16 is a perspective view of cooling members of the cooling device illustrated in FIG. 15.
Figure 17:
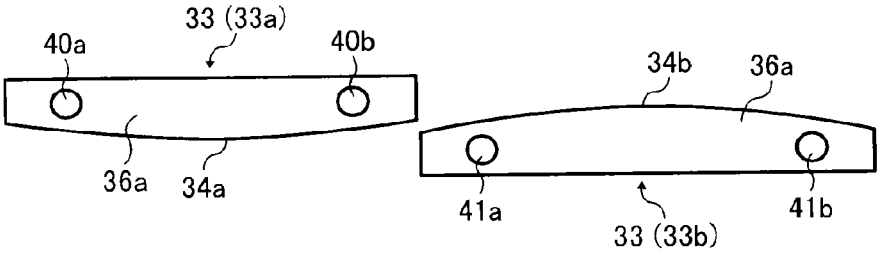
FIG. 17 is a side view of the cooling members of the cooling device illustrated in FIG. 15.

As illustrated in FIGS. 16 and 17, each of the cooling members 33*a* and 33*b* includes a cooling body 35 of a rectangular flat-plate shape and lateral edges 36*a* and 36*b* disposed at lateral faces of the cooling body 35. The cooling member 33*a* is not in contact with the cooling member 33*b* and is disposed upper than the cooling member 33*b*. The cooling body of the cooling member 33*a* has a heat absorbing surface 34*a* as a lower surface thereof, and the heat absorbing surface 34*a* has an arc surface shape slightly protruding downward. The cooling body 35 of the cooling member 33*b* has a heat absorbing surface 34*b* of an arc surface shape slightly protruding upward.

Each of the cooling members 33*a* and 33*b* includes a cooling liquid channel through which cooling liquid flows. At a side corresponding to a rear side of an image forming apparatus, the cooling member 33*a* has openings 40*a*, 40*b*, 41*a*, and 41*b* for circulation channels connected to the cooling liquid channel.

Next, the belt transport unit 30 is further described below.

As illustrated in FIG. 15, with respect to the recording-material transport direction, the first cooling member 33*a* inside the belt 56 of the first transport assembly 31 has a length shorter than the cooling member 33*b* inside the belt 59 of the second transport assembly 32. As a result, a contact area of the first cooling member 33*a* against an inner circumferential surface of the belt 56 is smaller than a contact area of the cooling member 33*b* against an inner circumferential surface of the belt 59. Thus, the first transport assembly 31 has a belt rotation resistance smaller than a belt rotation resistance of the second transport assembly 32.

In addition, as described below, the cooling members 33*a* and 33*b* are arranged so that the heat absorbing surfaces 34*a* and 34*b* of an arc surface shape partially overlap each other in an upward and downward direction. In other words, an upper end surface of the heat absorbing surface 34*b* of the cooling member 33*b* disposed at a lower side is disposed upper than a lower end surface of the heat absorbing surface 34*a* of the first cooling member 33*a* disposed at an upper side. The belt 56 is stretched so as to contact the heat absorbing surface 34*a* along the arc surface shape of the heat absorbing surface 34*a*, and the belt 59 is stretched so as to contact the heat absorbing surface 34*b* along the arc surface shape of the heat absorbing surface 34*b*. As a result, in the transport path of the recording material, the belts 56 and 59 do not horizontally travel but slightly meanders along the curved surfaces of the heat absorbing surfaces 34*a* and 34*b*. Accordingly, the belt 59 of the second transport assembly 32 has a larger belt rotation resistance to slide over the cooling member 33*b* having a larger contact area against the belt 59. By contrast, the belt 56 of the first transport assembly 31 has a lower belt rotation resistance to slide over the cooling member 33*a* having a smaller contact area against the belt 56. The driving roller 57*a* is disposed in the second transport assembly 32 having a larger belt rotation resistance. When the belt 59 is driven by the driving roller 57*a* in the second transport assembly 32, the belt 56 of the first transport assembly 31 is easily rotated by friction between the belt 59 of the second transport assembly 32 and the belt 56 of the first transport assembly 31, thus reducing a difference in rotation speed between the belts 56 and 59.

In other words, for example, if cooling members have heat absorbing surfaces of simple flat shapes, not arc surface shapes, or if a cooling member is disposed at an upper side or a lower side relative to a belt and a pressing roller is disposed at a position opposite the cooling member via the belt, the belt(s) might point-to-point contact the cooling member, not surface-to-surface contact. Thus, it is difficult to create a difference in belt rotation resistance between the two transport assemblies.

As a main factor by which the belt 56 is rotated by rotation of the belt 59, the friction (contact resistance) between the belts 56 and 59 is conceivable. Therefore, as described above, by slightly meandering the belts 56 and 59 along the curved surfaces of the heat absorbing surfaces 34*a* and 34*b*, a difference in belt rotation resistance is created and the belts 56 and 59 tightly contact each other. Thus, the belt 56 is reliably rotated by the friction between the belts 56 and 59.

Figure 18:
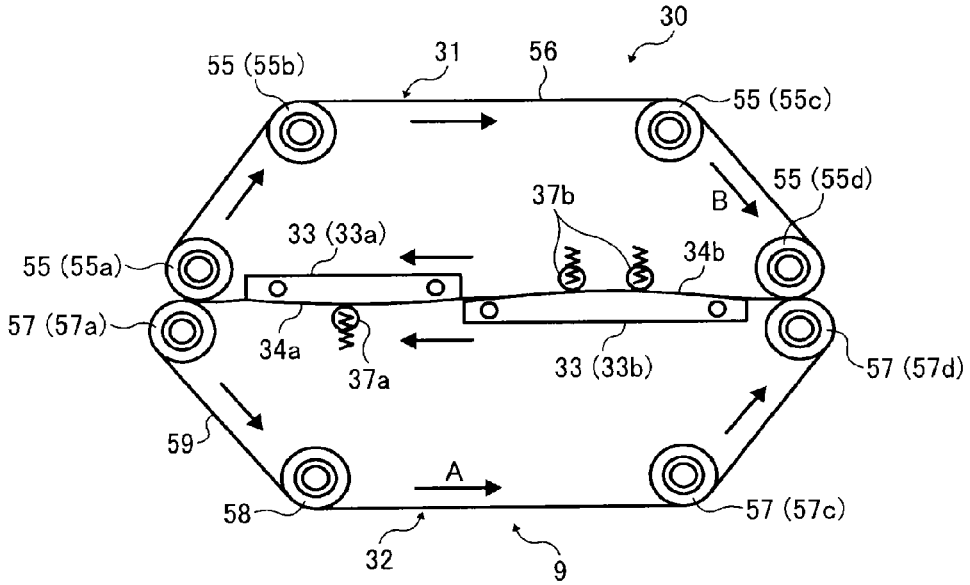
FIG. 18 is a side view of a cooling device according to an exemplary embodiment of this disclosure.

FIG. 18 is a side view of a cooling device 9 according to an exemplary embodiment of this disclosure.

For this exemplary embodiment, in addition to the configuration of the cooling device 9 illustrated in FIG. 15, a pressing roller 37*a* is disposed at a position opposite a position of the cooling member 33*a* via the belts 56 and 59. Pressing rollers 37*b* are disposed at positions opposite a position of the cooling member 33*b* via the belts 56 and 59. The pressing rollers 37*a* and 37*b* are urged by springs. The pressing roller 37*a* presses the belts 56 and 59 upward against the cooling member 33*a*, and the pressing rollers 37*b* presses the belts 56 and 59 downward against the cooling member 33*b*. Although the belts 56 and 59 contact the cooling members 33*a* and 33*b* along the heat absorbing surfaces 34*a* and 34*b*, for this exemplary embodiment, the pressing rollers 37*a* and 37*b* urged by the springs enhance the contact of the belts 56 and 59 and the cooling members 33*a* and 33*b*. The pressing rollers 37*a* and 37*b* are rotated by rotation of the belts 56 and 59 and hardly affect the belt rotation resistance of the second transport assembly 32 and the cooling members 33*a* and 33*b*. In FIG. 18, the cooling device 9 has one pressing roller 37*a* and two pressing rollers 37*b*. It is to be noted that any other suitable number of pressing rollers 37*a* and 37*b* may be provided.

Figure 19:
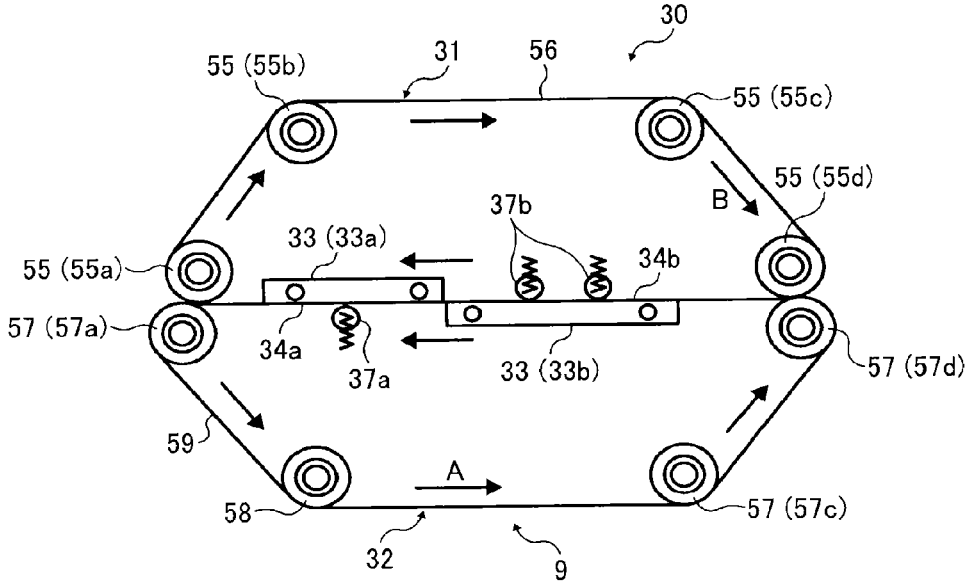
FIG. 19 is a side view of a cooling device according to a comparative example of this disclosure.

FIG. 19 is a side view of a cooling device 9 according to a comparative example of this disclosure.

For this example, unlike the configuration of the cooling device 9 illustrated in FIG. 15, cooling members 33*a* and 33*b* have flat contact surfaces, instead of arc-shaped heat absorbing surfaces. A pressing roller 37*a* is disposed at a position opposite the cooling member 33*a* via the belts 56 and 59. A pressing roller 37*b* is disposed at a position opposite the cooling member 33*b* via the belts 56 and 59. The pressing rollers 37*a* and 37*b* are urged by springs. The pressing roller 37*a* presses the belts 56 and 59 upward against the cooling member 33*a*, and the pressing rollers 37*b* presses the belts 56 and 59 downward against the cooling member 33*b*. However, since the belts 56 and 59 forming a recording-material transport path are substantially horizontally disposed, the belts 56 and 59 point-to-point contact the pressing rollers 37*a* and 37*b*, respectively, rather than surface-to-surface contact. Accordingly, such a configuration may be disadvantageous in creating a difference in belt rotation resistance.

Figure 20:
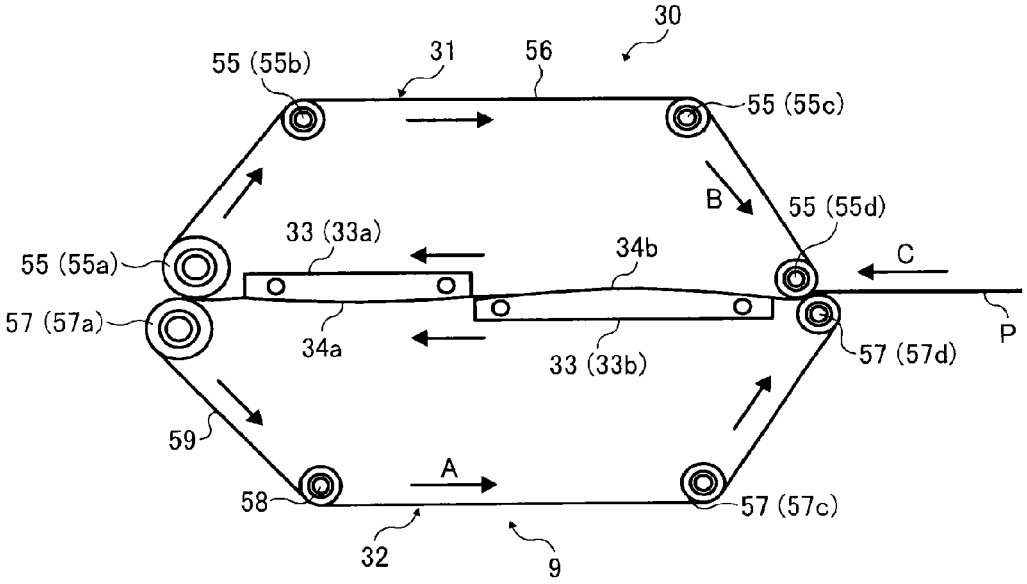
FIG. 20 is a side view of a cooling device according to an exemplary embodiment of this disclosure.

FIG. 20 is a side view of a cooling device 9 according to an exemplary embodiment of this disclosure.

In the cooling device 9 illustrated in FIG. 15 or 18, the driving roller 57*a* has a diameter equivalent to a diameter of each of the rollers 57*c*, 57*d*, and 58. By contrast, for this exemplary embodiment, as illustrated in FIG. 20, a driving roller 57*a* has a diameter greater than a diameter of each of follow rollers 57*c*, 57*d*, and 58. Such a greater diameter can reduce rotational error per rotation of the driving roller 57*a*, thus further reducing a difference in belt rotation speed caused by a difference in rotation speed. For this exemplary embodiment, for example, the driving roller 57*a* has a diameter of approximately 48 mm, and each of the follow rollers 57*c*, 57*d*, and 58 has a diameter of approximately 22 mm. It is to be noted that the values of the diameters are not limited to the above-described example but may be any suitable values.

For the cooling device 9 according to any of the above-described exemplary embodiments, the driving roller 57*a* is disposed at a most downstream side in a belt travelling direction (recording-material transport direction). Specifically, the driving roller 57*a* is disposed at a most downstream side in the recording-material transport path in the cooling device 9. Such a position of the driving roller 57*a* allows a portion of the belts 56 and 59 forming the recording-material transport path to be drawn at a proper tension, thus further facilitating reliable contact of the cooling members 33*a* and 33*b* and the belts 56 and 59. A follow roller 55*a* opposite the driving roller 57*a* has a diameter greater than any of other rollers 55*b*, 55*c*, and 55*d* of a first transport assembly 31 including the follow roller 55*a*. The belts 56 and 59 are endless belts including thin-film resin material, e.g., polyimide. Next, a cooling device 9 according to an exemplary embodiment of this disclosure is described with reference to FIG. 21.

Figure 21:
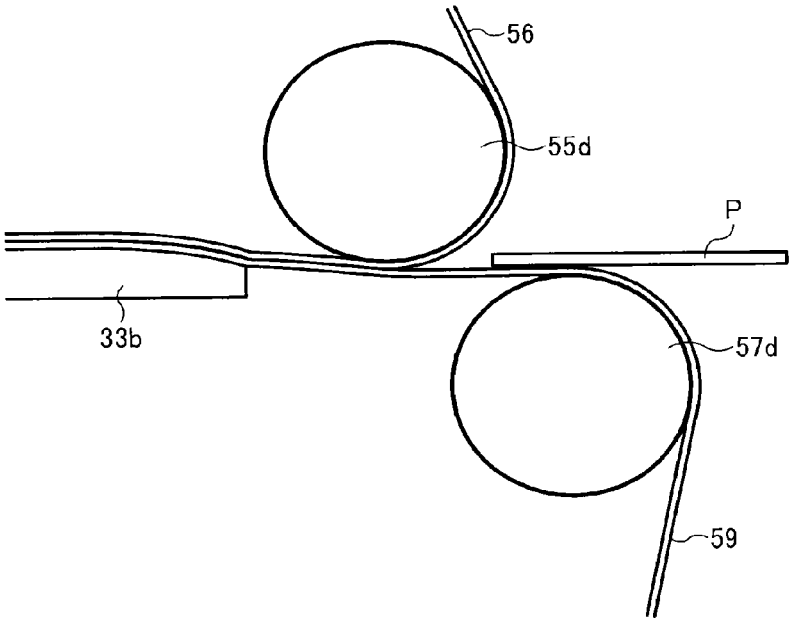
FIG. 21 is an enlarged view of an example of relative positions of the rollers illustrated in FIG. 15.

FIG. 21 is an enlarged view of two belts 56 and 59 stretched around rollers 55*d* and 57*d*, respectively.

The configuration of this exemplary embodiment is applicable to the cooling device 9 according to at least one of the above-described exemplary embodiments. As illustrated in FIG. 21, at a recording-material entry part in the cooling device 9, the roller 57*d* and the roller 55*d* serving as counter rollers are disposed away from each other in a recording-material transport direction. An upper end surface of the roller 57*d* disposed at a lower side is located at a position lower than a lower end surface of the roller 55*d* disposed at an upper side. As a result, a recording material P transported from a fixing device 8 smoothly enters the cooling device 9. A roller 55*a* and a driving roller 57*a* disposed at a recording-material exit portion of the cooling device 9 has a configuration similar to, if not the same as, the configuration of the roller 55*d* and the roller 57*d*. When a recording material P enters or exits from the cooling device 9, such a configuration prevents a fixed image borne on the recording material P from being damaged by a large burden imposed on the recording material P. A portion of the belt 56 contacting an outer circumference of the roller 55*d* does not contact a portion of the belt 59 contacting an outer circumference of the roller 57*d*. Accordingly, the belts 56 and 59 contact each other only on an area including the heat absorbing surfaces 34*a* and 34*b*. Such a configuration allows the belt 56 to be rotated mainly by friction force between the belts 56 and 59 with rotation of the belt 59.

Next, a variation of the exemplary embodiment illustrated in FIG. 21 is described with reference to FIG. 22.

Figure 22:
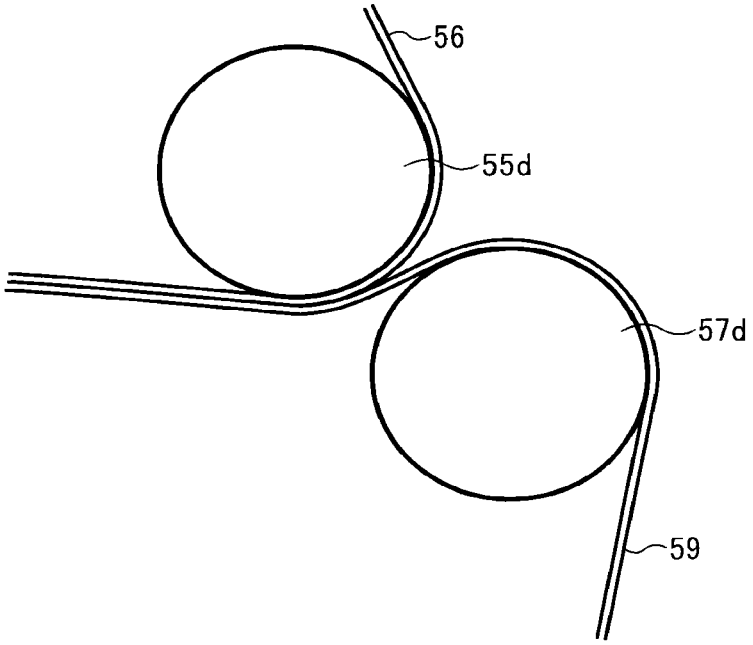
FIG. 22 is an enlarged view of a variation of relative positions of the rollers illustrated in FIG. 15.

FIG. 22 is an enlarged view of two belts 56 and 59 stretched around rollers 55*d* and 57*d*, respectively. Instead of the configuration of the above-described exemplary embodiment illustrated in FIG. 21, the configuration of this exemplary embodiment is applicable to the cooling device 9 according to at least one of the above-described exemplary embodiments. As illustrated in FIG. 22, at a recording-material entry part in the cooling device 9, the roller 57*d* and the roller 55*d* are disposed away from each other in a recording-material transport direction. The roller 55*d* and the roller 57*d* are arranged to overlap each other in an upward and downward direction (i.e., a direction crossing the recording-material transport direction). In other words, an upper end surface of the roller 57*d* disposed at a lower side is disposed at a position upper than a lower end surface of the roller 55*d* disposed at an upper side. A roller 55*a* and a driving roller 57*a* disposed at a recording-material exit part of the cooling device 9 has a configuration similar to, if not the same as, the configuration of the roller 55*d* and the roller 57*d*. The belts 56 and 59 contact each other on an area including the heat absorbing surfaces 34*a* and 34*b* and a portion of the belt 56 contacting an outer circumference of the roller 55*d*. As a result, with a pressing action by the heat absorbing surfaces 34*a* and 34*b* of an arc surface shape arranged to overlap each other in the upward and downward direction, the belts 56 and 59 more intensively contact each other, thus allowing the belt 56 to be more stably rotated by friction force with rotation of the belt 59. The rollers 55*d* and 57*d* are also disposed away from each other taking into account the thicknesses of recording materials. Such a configuration allows a recording material P transported from the fixing device 8 to smoothly enter the cooling device 9.

Figure 23:
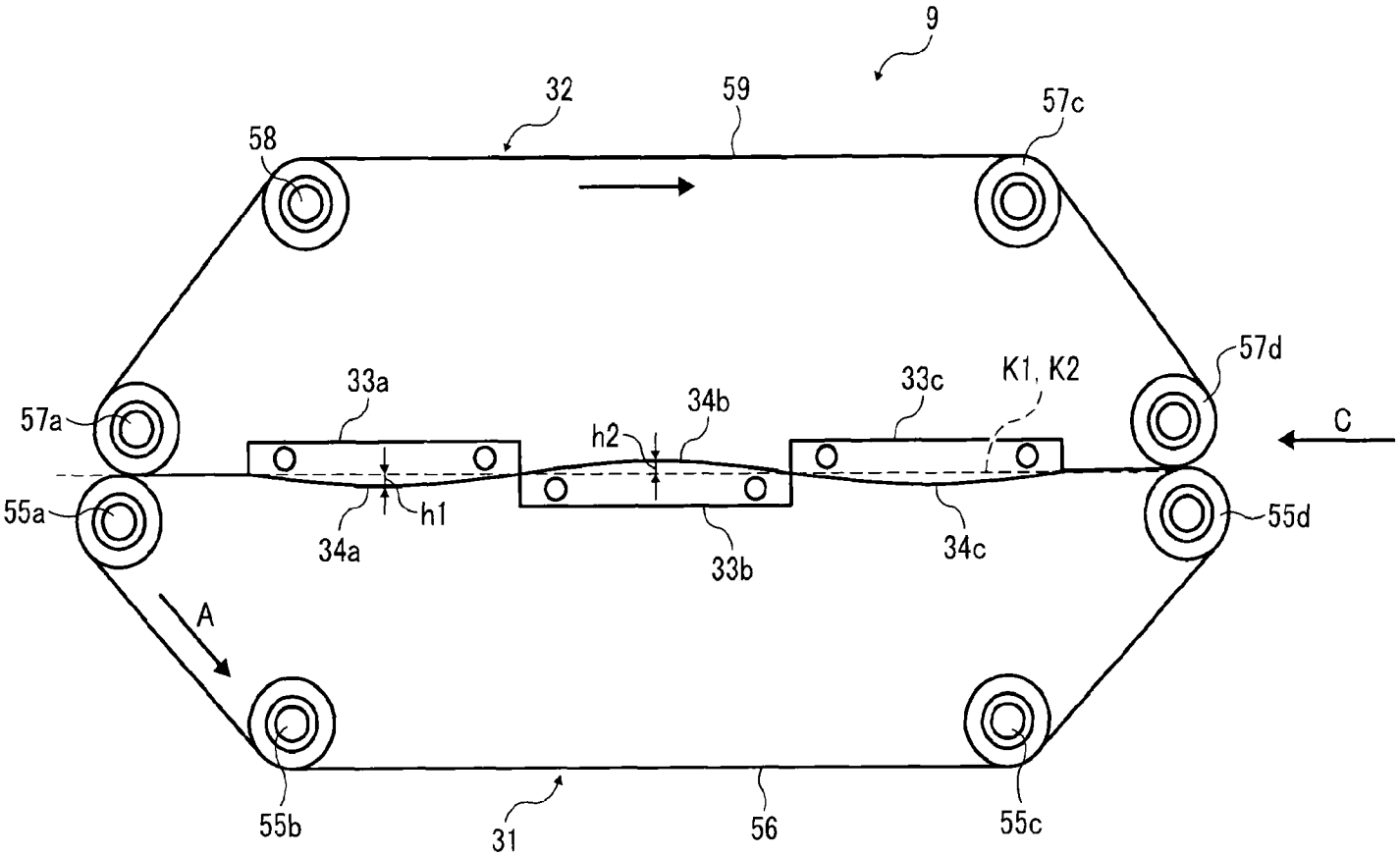
FIG. 23 is a side view of a cooling device according to an exemplary embodiment of this disclosure.

FIG. 23 is a side view of a cooling device 9 according to an exemplary embodiment of this disclosure.

The number of cooling members in the cooling device 9 is not limited two but may be three or more. For example, in FIG. 23, the cooling device 9 has three cooling members

33*a*, 33*b*, and 33*c* (collectively referred to as cooling members 33 unless distinguished). In addition, unlike the above-described exemplary embodiments, in the cooling device 9 according to this exemplary embodiment, a first transport assembly 31 is disposed at a lower side and a second transport assembly 32 is disposed at an upper side. However, the same reference codes are allocated to the same components and elements as those of the above-described exemplary embodiments, and redundant descriptions thereof are omitted below.

In this exemplary embodiment, the cooling members 33 are arranged in an order of upper side, lower side, and upper side from an upstream side to a downstream side in a transport direction C of a recording material P. The cooling members 33*a*, 33*b*, and 33*c* have substantially the same shape. The second transport assembly 32 has a greater number of cooling members (33*a* and 33*c*) than the first transport assembly 31. Thus, a total contact area of the cooling members 33*a* and 33*c* relative to an inner circumferential surface of the belt 59 is greater than a contact area of the cooling member 33*b* relative to an inner circumferential surface of the belt 56. As a result, the first transport assembly 31 has a belt rotation resistance smaller than the second transport assembly 32. The driving roller 57*a* is disposed in the second transport assembly 32 having a larger belt rotation resistance.

Here, an upper end surface of a heat absorbing surface 34*b* of the cooling member 33*b* disposed at a lower side is disposed at a position upper than lower end surfaces of heat absorbing surfaces 34*a* and 34*c* of the cooling members 33*a* and 33*c* disposed at an upper side. Here, h1 represents a distance between a lower end surface of each of the heat absorbing surfaces 34*a* and 34*c* and an imaginary line (horizontal line) K1 connecting a lower end surface of the driving roller 57*a* to a lower end surface of the follow roller 57*d*, and h2 represents a distance between an upper end surface of a heat absorbing surfaces 34*b* and an imaginary line (horizontal line) K2 connecting upper end surfaces of the follow rollers 55*a* and 55*d*. Then, the cooling members 33*a*, 33*b*, and 33*c* are arranged so as to satisfy a relation of $h2<h1$. As a result, a belt rotation resistance due to the contact of the cooling member 33*b* of the first transport assembly 31 relative to the inner circumferential surface of the belt 56 is further reliably reduced to a value smaller than a belt rotation resistance due to the contact of the cooling members 33*a* and 33*c* relative to the inner circumferential surface of the belt 59 Additionally, such a configuration allows the belt 56 to be stably rotated by rotation of the belt 59, thus reducing a difference in rotation speed between the belts 56 and 59.

In a configuration in which a plurality of cooling members is provided, the plurality of cooling members preferably has the same shape to give an effect of cost reduction by mass production. In addition, the plurality of cooling members preferably has a difference in belt rotation resistance. Hence, in this exemplary embodiment, the number of cooling members in the second transport assembly 32 including the driving roller 57*a* is greater than the number of cooling members in the first transport assembly 31 not including the driving roller 57*a*. In a configuration in which the plurality of cooling members has the same length like this exemplary embodiment, an odd number of cooling members are preferably provided in the cooling device 9 to create a difference in belt rotation resistance. By contrast, in a configuration illustrated in FIG. 15 in which the cooling members have two types of length, an even number of cooling members is provided in the cooling device 9. Alternatively, for example, two cooling members each having a length of one third of the distance L are disposed at an upper side, and a cooling member having a length of the distance L is provided in the cooling device 9 so that an odd number of cooling members in total is provided in the cooling device 9.

Figure 24:
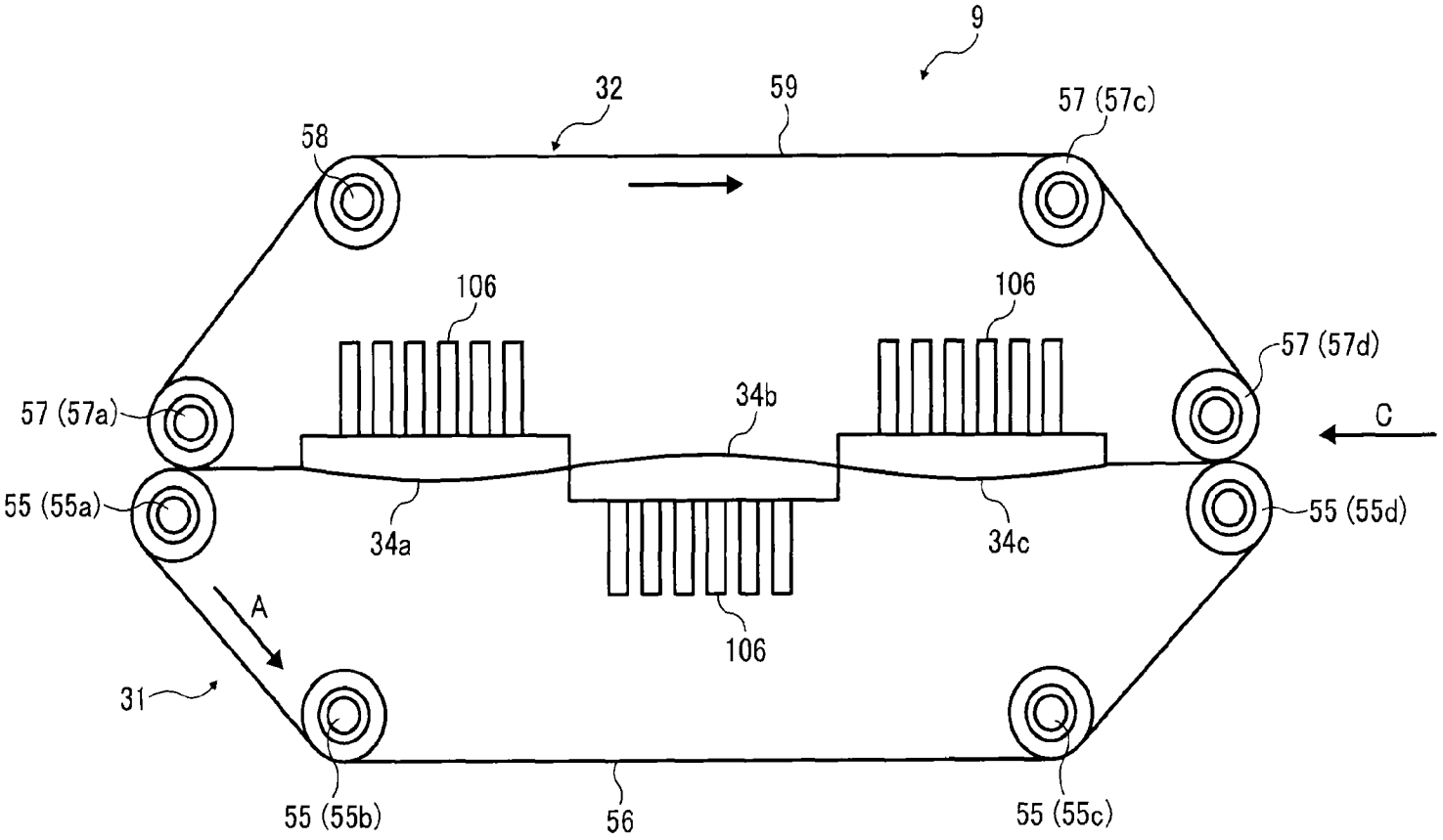
FIG. 24 is a side view of a cooling device according to an exemplary embodiment of this disclosure.

FIG. 24 is a side view of a cooling device 9 according to an exemplary embodiment of this disclosure.

Embodiments of this disclosure are not limited to the cooling device 9 employing the cooling-liquid circuit 44 in FIG. 5 but, for example, as illustrated in FIG. 24, the cooling device 9 may include, as cooling members, air-cooling heat sinks 106 having multiple fins, instead of the cooling-liquid circuit 44. In such a configuration, the configuration of at least one of the above-described exemplary embodiments is applicable to, for example, the shapes of heat absorbing surfaces 34*a*, 34*b*, and 34*c* and relative positions of the heat absorbing surfaces 34*a*, 34*b*, and 34*c*.

Use of the air-cooling heat sinks 106 obviates use of the cooling-liquid circuit 44, thus allowing downsizing and cost reduction of the cooling device.

Figure 25:
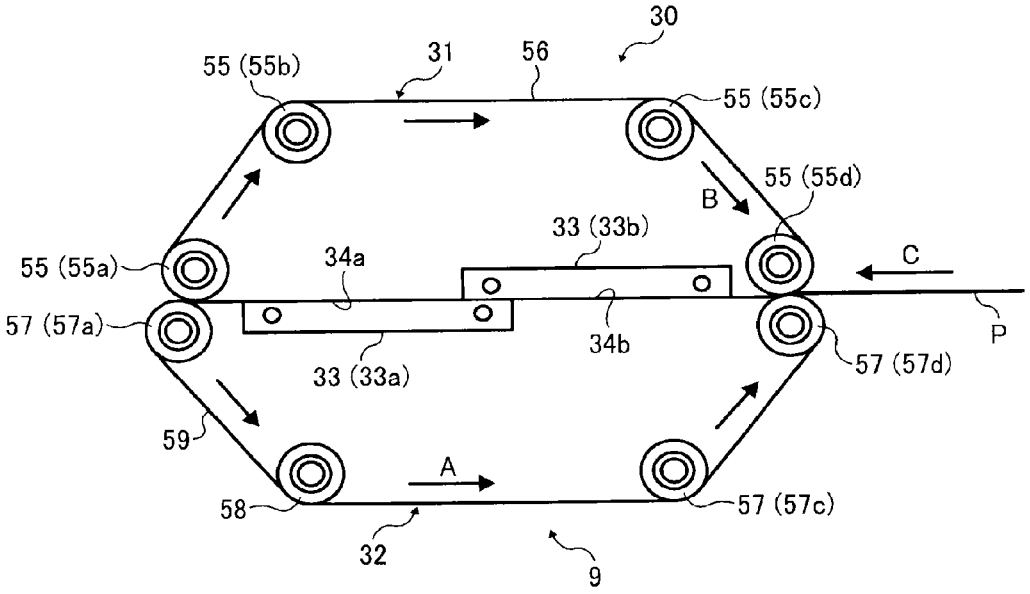
FIG. 25 is a side view of a cooling device according to an exemplary embodiment of this disclosure.

FIG. 25 is a schematic view of a cooling device 9 according to an exemplary embodiment of this disclosure.

As illustrated in FIG. 25, the cooling device 9 includes a belt transport unit 30 and cooling members 33 (33*a* and 33*b*) to cool a recording material P transported by traveling of belts 56 and 59 of the belt transport unit 30. The belt transport unit 30 includes a first transport assembly 31 and a second transport assembly 32. The first transport assembly 31 is disposed at one face side (front face side or upper face side) of the recording material P. The second transport assembly 32 is disposed at the other face side (back face side or lower face side) of the recording material P. Each of the first transport assembly 31 and the second transport assembly 32 has belts 56 and 59 serving as belt members rotatably held by and stretched over a plurality of rollers 55, 57, and 58 serving as stretching members. The belt transport unit 30 also includes a pair of cooling members 33*a* and 33*b* disposed in contact with inner circumferential surfaces of the belts 56 and 59, respectively. The cooling member 33*a* is disposed at one face side (back face side or lower face side) of the recording material P. The cooling member 33*b* is disposed at the other face side (front face side or upper face side) of the recording material P.

In the cooling device 9 illustrated in FIG. 25, the cooling member 33*b* disposed at the upper side and the cooling member 33*a* disposed at the lower side partially overlap each other in the recording-material transport direction indicated by arrow C in FIG. 25. At the upper side of the cooling device 9, the belt 56 is applied with tension and brought into close contact with the heat absorbing surface 34*b* of the cooling member 33*b*. At the lower side of the cooling device 9, the belt 59 is applied with tension and brought into close contact with the heat absorbing surface 34*a* of the cooling member 33*a*. A portion of the belt 59 at the lower side that faces the cooling member 33*b* at the upper side is applied with a tension enough to prevent occurrence of a downward slack due to the rigidity of a leading end of a recording material P. Accordingly, when the belt 56 at the upper side contacts the recording material P transported, heat of the recording material P is transmitted to the heat absorbing surface 34*b* via the belt 56. The belt 59 at the lower side has a function as a guide member to guide transport of the recording material P to an area of the belt 56 at the upper side and guide a leading end of the recording material P to an overlapping area in which the cooling member 33*b* at the upper side overlaps the cooling member 33*a* at the lower side. Such a configuration suppresses striking of the leading end of the recording material against a side face (right side face in FIG. 25) of the cooling member 33*a* and buckling of the recording material P. Thus, such a configuration prevents the recording material P from being jammed or caught at a juncture of the cooling member 33*b* at the upper side and the cooling member 33*a* at the lower side.

Next, a cooling device 9 according to an exemplary embodiment of this disclosure is described below.

Figure 26A:
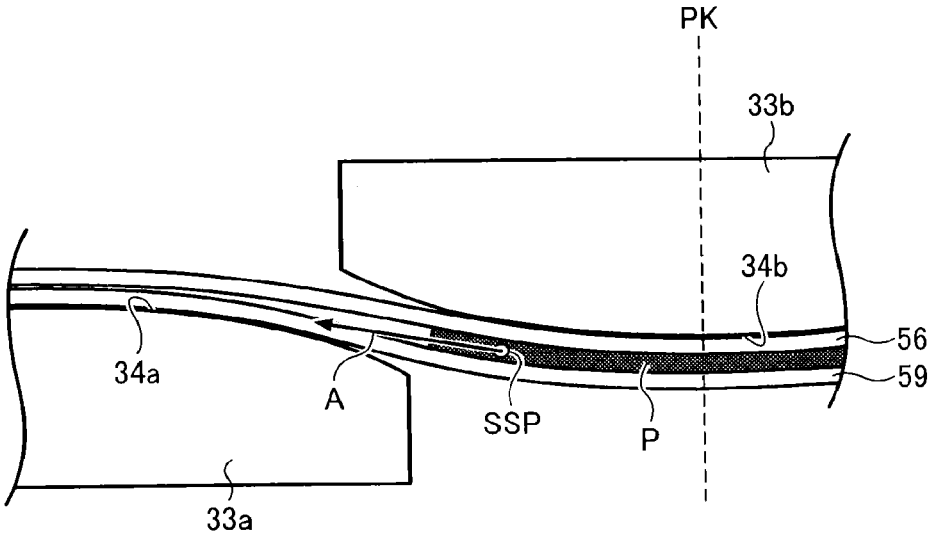
FIGS. 26A and 26B are enlarged views of a cooling device according to an exemplary embodiment of this disclosure.
Figure 26B:
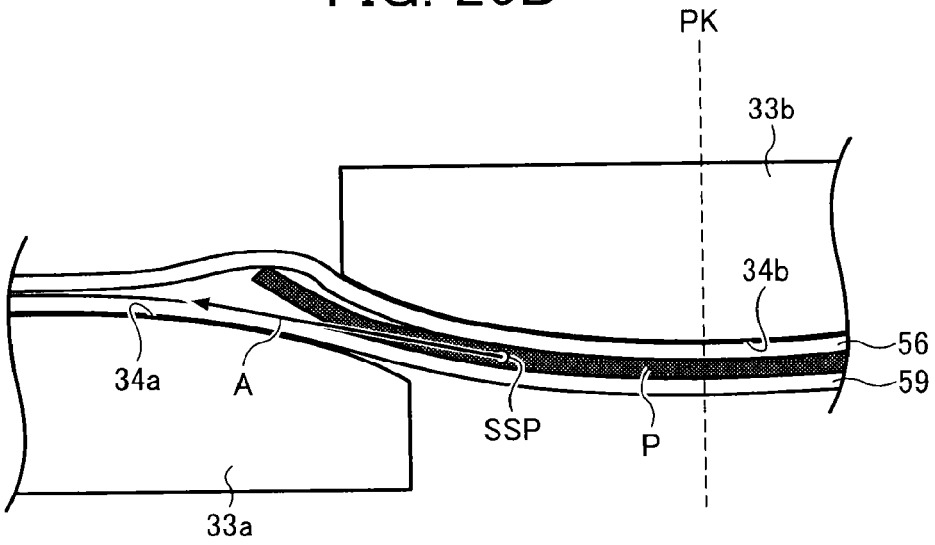

In the cooling device 9 illustrated in FIGS. 26A and 26B, opposed cooling members 33*a* and 33*b* partially overlap each other in a transport direction C of a recording material P. Heat absorbing surfaces 34*a* and 34*b* of the cooling members 33*a* and 33*b* to contact the belts 59 and 56, respectively, are convex, not flat. When the heat absorbing surface 34*b* of the cooling member 33*b* disposed at an upper side has a convex, curved surface, the recording material P is transported along the curved surface. The belt 59 disposed at a lower side is applied with tension. Accordingly, when the recording material P passes the cooling member 33*b* at the upper side, the recording material P starts separating from the belt 56 (cooling member 33*b*) at a separation start point SSP that is disposed between a peak PK of the heat absorbing surface 34*b* and the cooling member 33*a* at the lower side and downstream from the peak 7A of the heat absorbing surface 34*b* in the transport direction (FIG. 26A). At this time, since the recording material P advances in a tangential direction of a curved surface at the separation start point SSP, an upward force acts on the recording material P, thus facilitating the recording material P to be guided into between the cooling member 33*b* at the upper side and the cooling member 33*a* at the lower side.

Here, when the heat absorbing surface 34*b* of the cooling member 33*b* at the upper side has a convex, curved surface, the effect of guiding the recording material is obtained. Thus, the heat absorbing surface 34*a* of the cooling member 33*a* at the lower side may be flat. However, when both the heat absorbing surfaces 34*a* and 34*b* are convex and curved surfaces, the cooling members 33*a* and 33*b* can be formed with one type of member, thus allowing cost reduction. The belt 59 at the lower side has a function as a guide member to guide transport of the recording material P to an area of the belt 56 at the upper side and guide a leading end of the recording material P to an overlapping area in which the cooling member 33*b* at the upper side overlaps the cooling member 33*a* at the lower side.

In addition, as described below, the cooling members 33*b* and 33*a* are arranged so that the heat absorbing surfaces 34*b* and 34*a* of an arc surface shape partially overlap each other in a direction perpendicular to the transport direction C. In other words, an upper end surface of the heat absorbing surface 34*a* of the cooling member 33*a* disposed at a lower side is disposed upper than a lower end surface of the heat absorbing surface 34*b* of the first cooling member 33*b* disposed at an upper side. The belt 56 is stretched so as to contact the heat absorbing surface 34*b* along the arc surface shape of the heat absorbing surface 34*b*, and the belt 59 is stretched so as to contact the heat absorbing surface 34*a* along the arc surface shape of the heat absorbing surface 34*a*. As a result, in the transport path of the recording material, the belts 56 and 59 do not horizontally travel but slightly meanders along the curved surfaces of the heat absorbing surfaces 34*a* and 34*b*.

As a main factor by which the belt 56 is rotated by rotation of the belt 59, the friction (contact resistance) between the belts 56 and 59 is conceivable. Therefore, by slightly meandering the belts 56 and 59 along the curved surfaces of the heat absorbing surfaces 34*a* and 34*b*, a difference in belt rotation resistance is created and the belts 56 and 59 tightly contact each other. Thus, the belt 56 is reliably rotated by the friction between the belts 56 and 59.

In addition, since the heat absorbing surfaces 34*a* and 34*b* are convex, attaching forces (contact pressure) from the belts 56 and 59 act on the entire heat absorbing surfaces 34*a* and 34*b*, the belts 56 and 59 receive, as a reaction, a downward attaching force (contact pressure) from the heat absorbing surface 34*b*. Thus, tension of the belts 56 and 59 allows more reliable attachment of the recording material P, the belts 56 and 59, and the cooling members 33*a* and 33*b*.

Figure 27A:
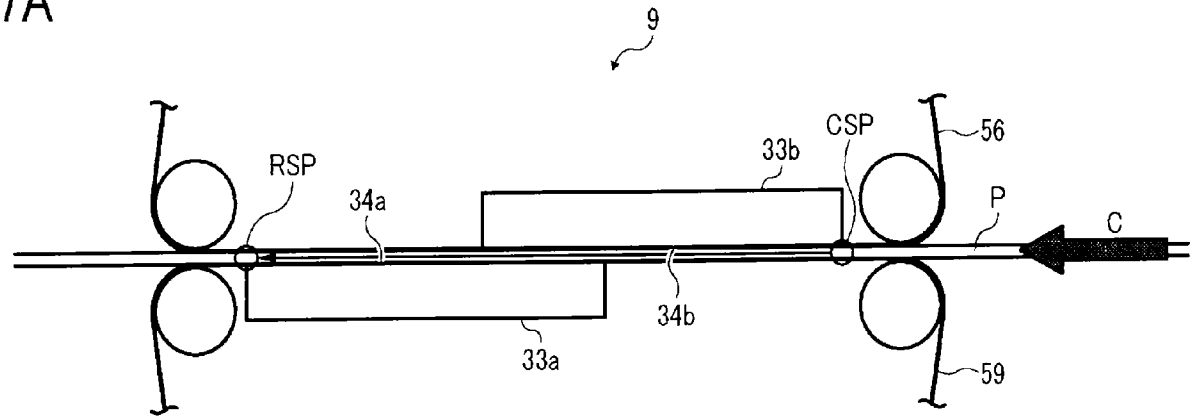
FIG. 27A is a schematic view of belts and cooling members according to an exemplary embodiment of this disclosure.
Figure 27B:
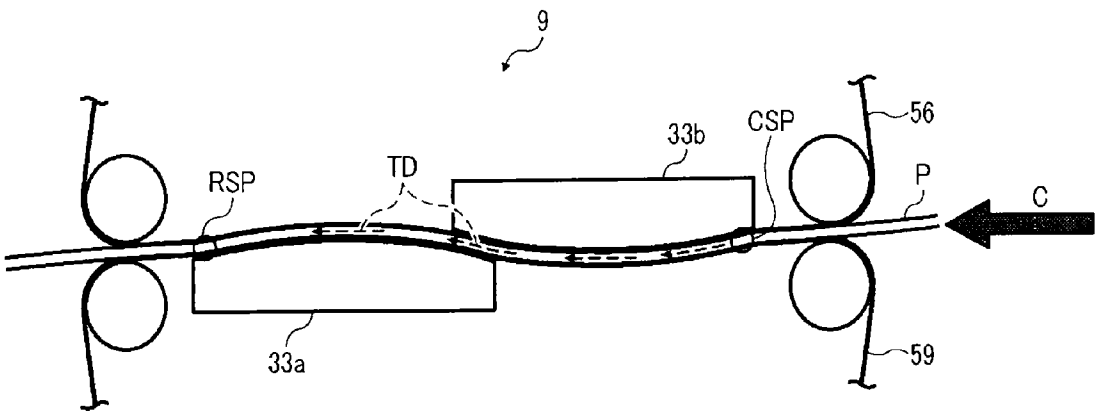
FIG. 27B is a schematic view of belts and cooling members according to an exemplary embodiment of this disclosure.

FIG. 27A is a schematic view of belts 56 and 59 and cooling members 33*b* and 33*a* according to an exemplary embodiment of this disclosure. FIG. 27B is a schematic view of belts 56 and 59 and cooling members 33*b* and 33*a* according to another exemplary embodiment of this disclosure.

In each of FIGS. 27A and 27B are shown a contact start point CSP at which the belt 56 starts contacting the cooling member 33*b* and a release start point RSP at which the belt 59 starts releasing from the cooling member 33*a*. A cooling device 9 illustrated in FIG. 27A includes the cooling members 33*a* and 33*b* having flat heat absorbing surfaces 34*a* and 34*b*. The contact start point CSP of the belt 56 relative to the cooling member 33*b* is located at a most upstream portion of the cooling member 33*b* on an upstream side in a transport direction indicated by arrow C. The release start point RSP of the belt 59 relative to the cooling member 33*a* is located at a most downstream portion of the cooling member 33*a* on a downstream side in the transport direction C. In such a case, the cooling member 33*b* disposed at an upper side and the cooling member 33*a* disposed at a lower side overlap each other in a direction connecting the contact start point CSP and the release start point RSP. A cooling device 9 illustrated in FIG. 27B includes cooling members 33*a* and 33*b* having convex heat absorbing surfaces 34*a* and 34*b*. In this exemplary embodiment as well, the contact start point CSP of the belt 56 relative to the cooling member 33*b* is located at a most upstream portion of the cooling member 33*b* at an upstream side in a transport direction C. The release start point RSP of the belt 59 relative to the cooling member 33*a* is located at a most downstream portion of the cooling member 33*a* at a downstream side in the transport direction C. In such a case, the cooling member 33*b* disposed at an upper side and the cooling member 33*a* disposed at a lower side overlap each other in a direction connecting the contact start point CSP and the release start point RSP. In other words, the cooling members 33*a* and 33*b* do not overlap at multiple points in different transport directions of the recording material indicated by arrows TD in FIG. 27B during transport of the recording material (FIG. 27B).

Next, a cooling device 9 according to an exemplary embodiment of this disclosure is described below.

Figure 28:
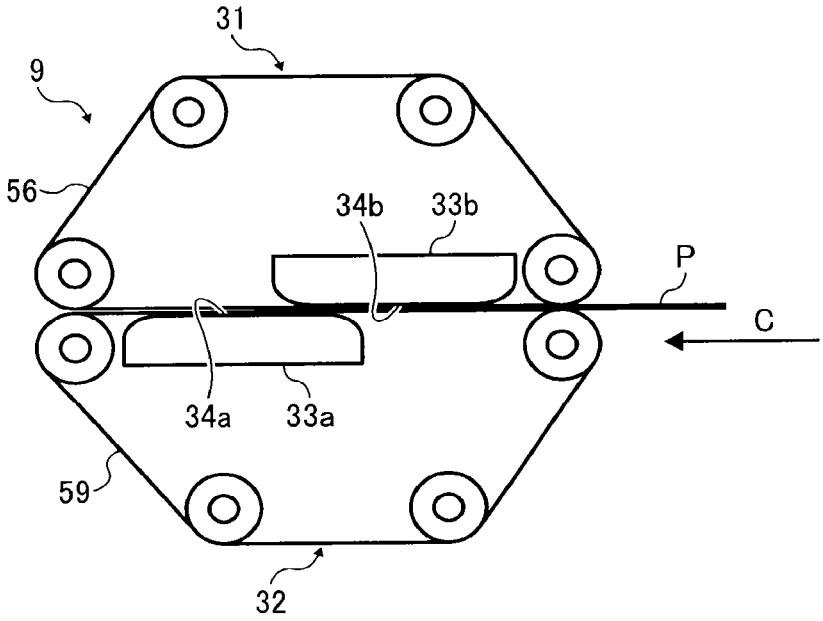
FIG. 28 is a side view of a cooling device according to an exemplary embodiment of this disclosure.
Figure 29A:
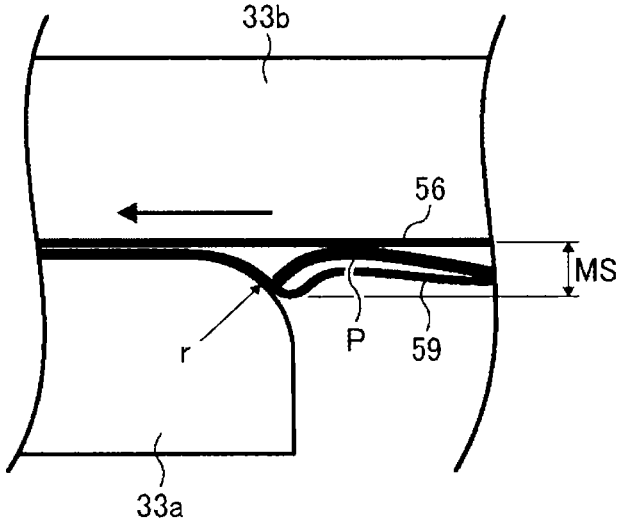
FIGS. 29A and 29B are schematic views of transport of a recording material in an overlapping area of cooling members.
Figure 29B:
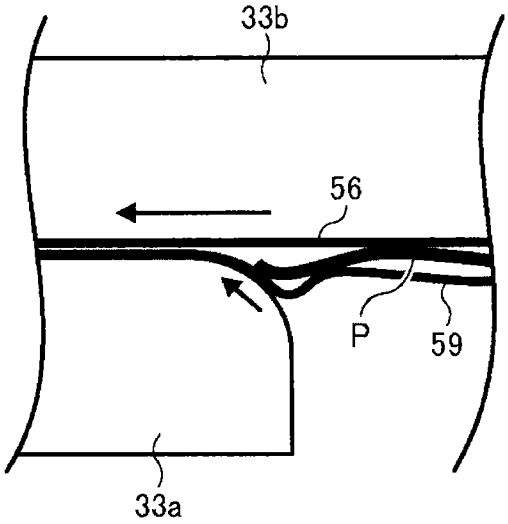

In the cooling device 9 illustrated in FIG. 28, opposed cooling members 33*a* and 33*b* partially overlap each other in a transport direction C of a recording material P. A belt 59 at a lower side has a function as a guide member to guide transport of the recording material P to an area of the belt 56 at an upper side and guide a leading end of the recording material P to an overlapping area in which the cooling member 33*b* at the upper side overlaps the cooling member 33*a* at the lower side. Heat absorbing surfaces 34*a* and 34*b* of the cooling members 33*a* and 33*b* to contact the belts 59 and 56, respectively, are flat. Ends of the heat absorbing surfaces 34*a* and 34*b* have curved surfaces. The cooling member 33*a* preferably has an end of a curved surface at an entry side of a recording material in the transport direction C. For such a configuration, even if the belt 59 slacks and is caught on the end of the cooling member 33*a* (FIG. 29A) when a recording material P passes the end of the cooling member 33*a* at the recording-material entry side, a leading end of the recording material P is smoothly guided upward by transport with the belts 56 and 59 (FIG. 29B), thus suppressing transport error. As illustrated in FIG. 29A, the radius r of curvature of the curved surface is designed to be greater than a maximum slack amount MS of each of the belts 56 and 59 in a direction perpendicular to the transport direction C, thus preventing the recording material P from being caught on a portion other than the curved surface.

Figure 30A:
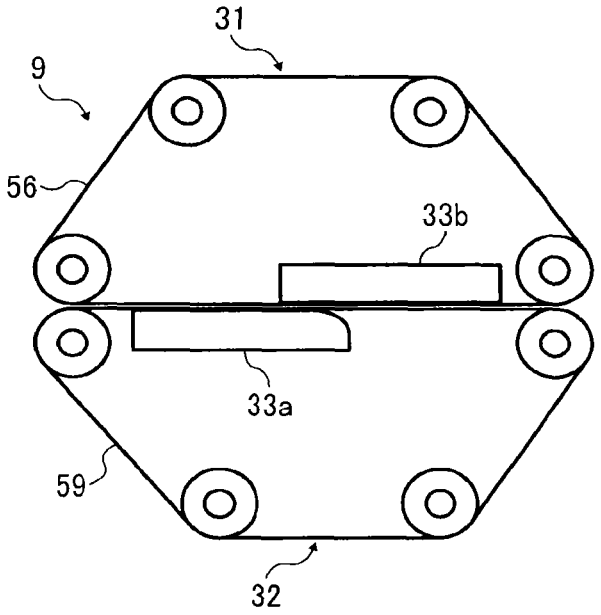
FIG. 30A is a side view of a cooling device according to an exemplary embodiment of this disclosure.
Figure 30B:
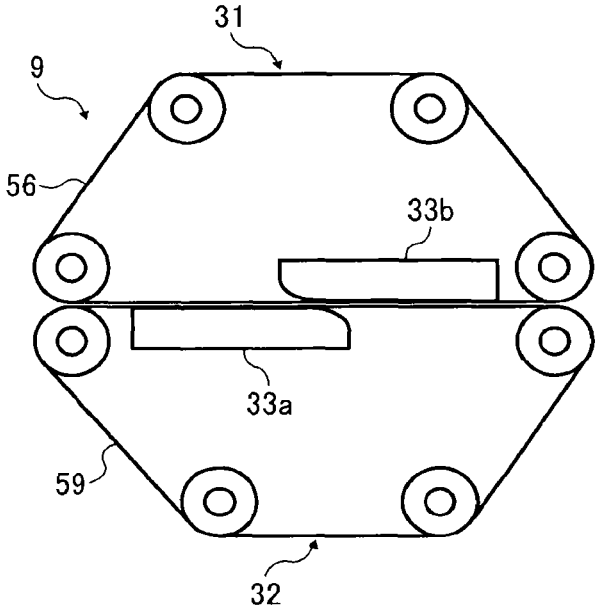
FIG. 30B is a side view of a cooling device according to an exemplary embodiment of this disclosure.

By contrast, since the recording material P is generally not caught on the cooling member 33*b* upstream in the transport direction, as illustrated in FIG. 30A, the cooling member 33*b* may have no end of a curved surface shape. However, as illustrated in FIG. 30B, the cooling member 33*b* may have an end of a curved surface shape at an exit side of the recording material P in the transport direction C. Such a configuration allows the cooling members 33*a* and 33*b* to be formed with the same type of member.

Next, a cooling device 9 according to an exemplary embodiment of this disclosure is described below.

Figure 31A:
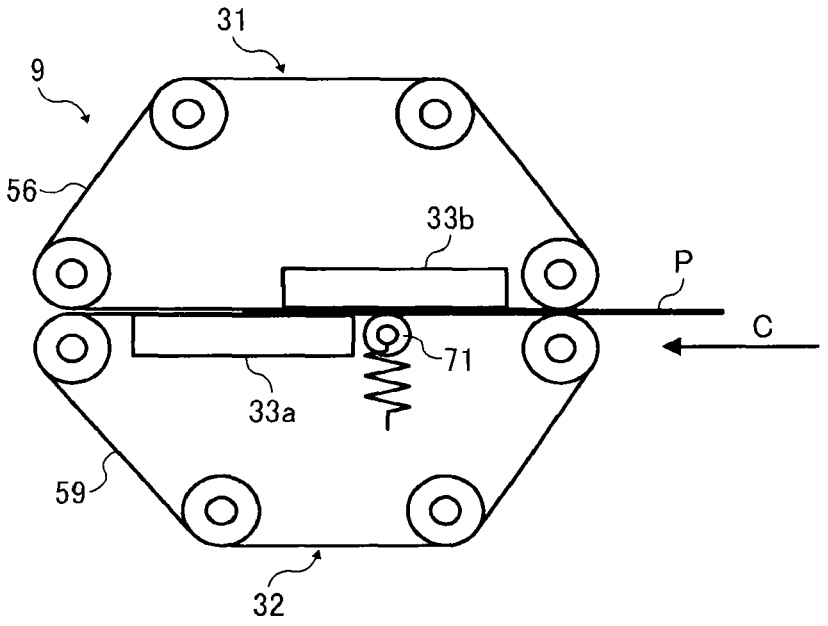
FIG. 31A is a side view of a cooling device according to an exemplary embodiment of this disclosure.
Figure 31B:
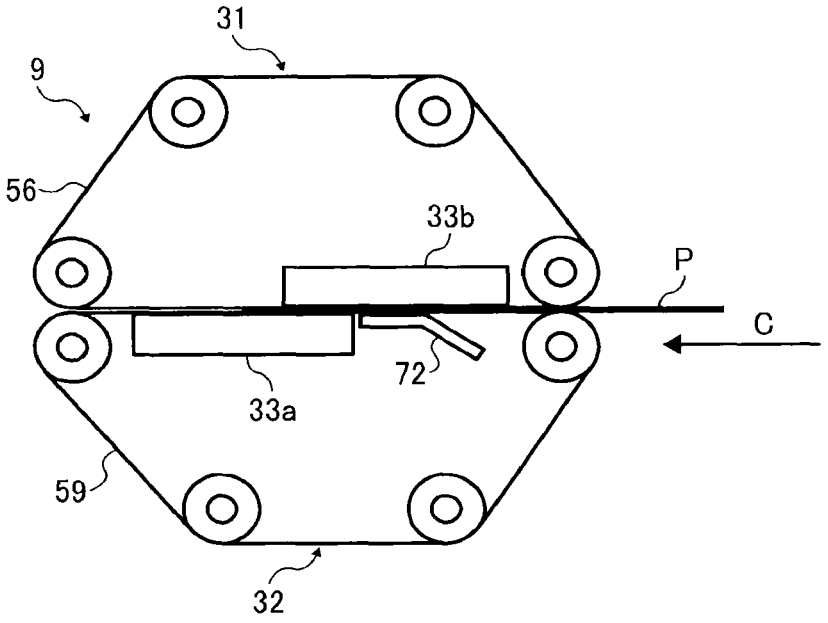
FIG. 31B is a side view of a cooling device according to an exemplary embodiment of this disclosure.

In the cooling device 9 illustrated in FIG. 31A, opposed cooling members 33*a* and 33*b* partially overlap each other in a transport direction C of a recording material P. A roller 71 serving as a guide member is disposed near an end at a recording-material entry side of the cooling member 33*a* downstream in the transport direction. The roller 71 is urged by a spring and presses the belt 59 upward by an urging force of the spring. The roller 71 is rotated with travel of the belt 59. The roller 71 guides the recording material P from a non-overlapping area to an overlapping area of the cooling member 33*b* and the cooling member 33*a*. The roller 71 also guides the recording material P toward the belt 56 opposite the belt 59 at a side at which the roller 71 is disposed. Similarly, in a cooling device 9 illustrated in FIG. 31B, a guide plate 72 serving as a guide member is disposed near an end at a recording-material entry side of a cooling member 33*a* downstream in a transport direction C. The guide plate 72 guides a recording material P from a non-overlapping area to an overlapping area of a cooling member 33*b* and the cooling member 33*a*. The guide plate 72 has a bent shape and is disposed to slidingly contact a belt 59. The guide plate 72 guides a recording material P toward a belt 56 opposite the belt 59 at a side which the guide plate 72 is disposed. Thus, the guide plate 72 smoothly guides the recording material P to the overlapping area of the cooling members 33*a* and 33*b*.

Figure 37A:
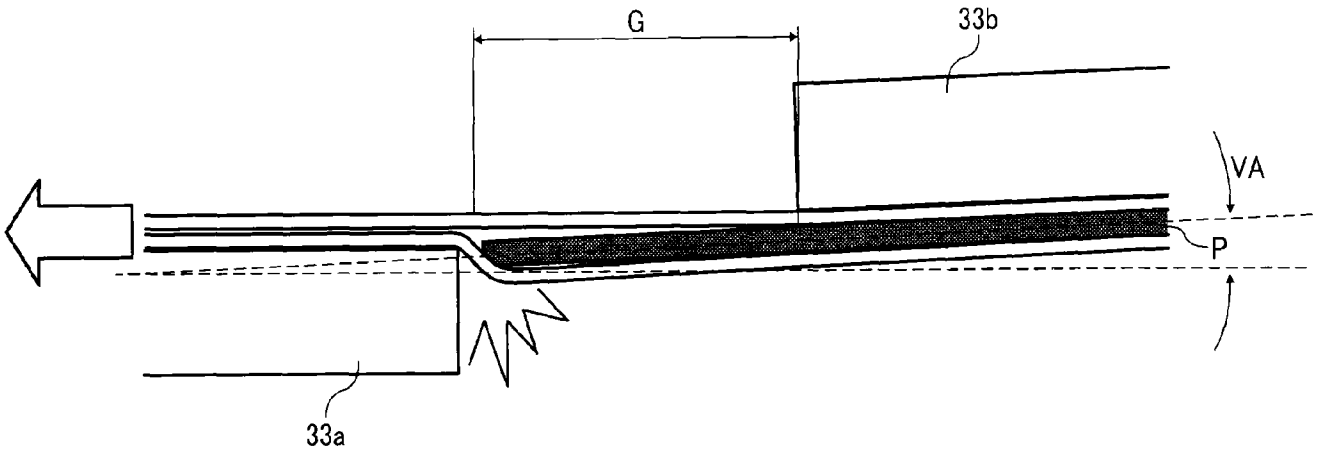
FIG. 37A is a schematic view of an example of a transport error in a comparative example of transport of a recording material.

For example, as illustrated in FIG. 37A, in a configuration in which cooling members 33*a* and 33*b* are arranged alternately at lower and upper sides so as to be placed away from each other in a transport direction of a recording material P, variances VA in setting angles of the cooling members 33*a* and 33*b* or other factors may cause an increased error in the entry angle of the recording material P in an area G between the cooling members 33*a* and 33*b*. As a result, a leading end of the recording material P may be transported at an unexpected angle or fluctuated. In such a case, the amplitude of the recording material P in the area G between the cooling members 33*a* and 33*b* may increase. When the recording material P moves to the cooling member 33*a* downstream in the transport direction, the recording material P may be caught on the cooling member 33*a*, thus causing a transport error.

Figure 37B:
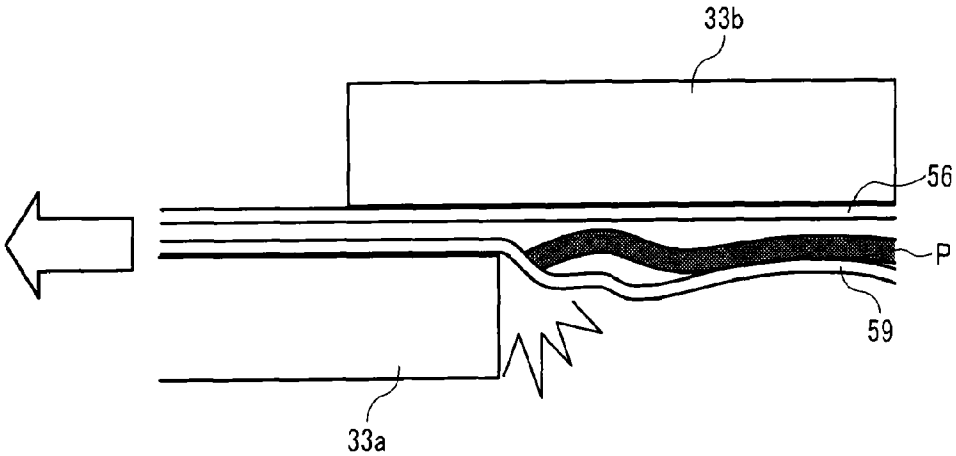
FIG. 37B is a schematic view of an example of a transport error in a comparative example of transport of a recording material.

In addition, as illustrated in FIG. 37B, even in a configuration in which a cooling member 33*a* at a lower side and a cooling member 33*b* at an upper side partially overlap each other in the transport direction, if a recording material P is transported while fluctuating due to insufficient tension of conveyance belts 56 and 59, the recording material P may not enter well between the cooling members 33*a* and 33*b*, thus causing a transport error.

Figure 32:
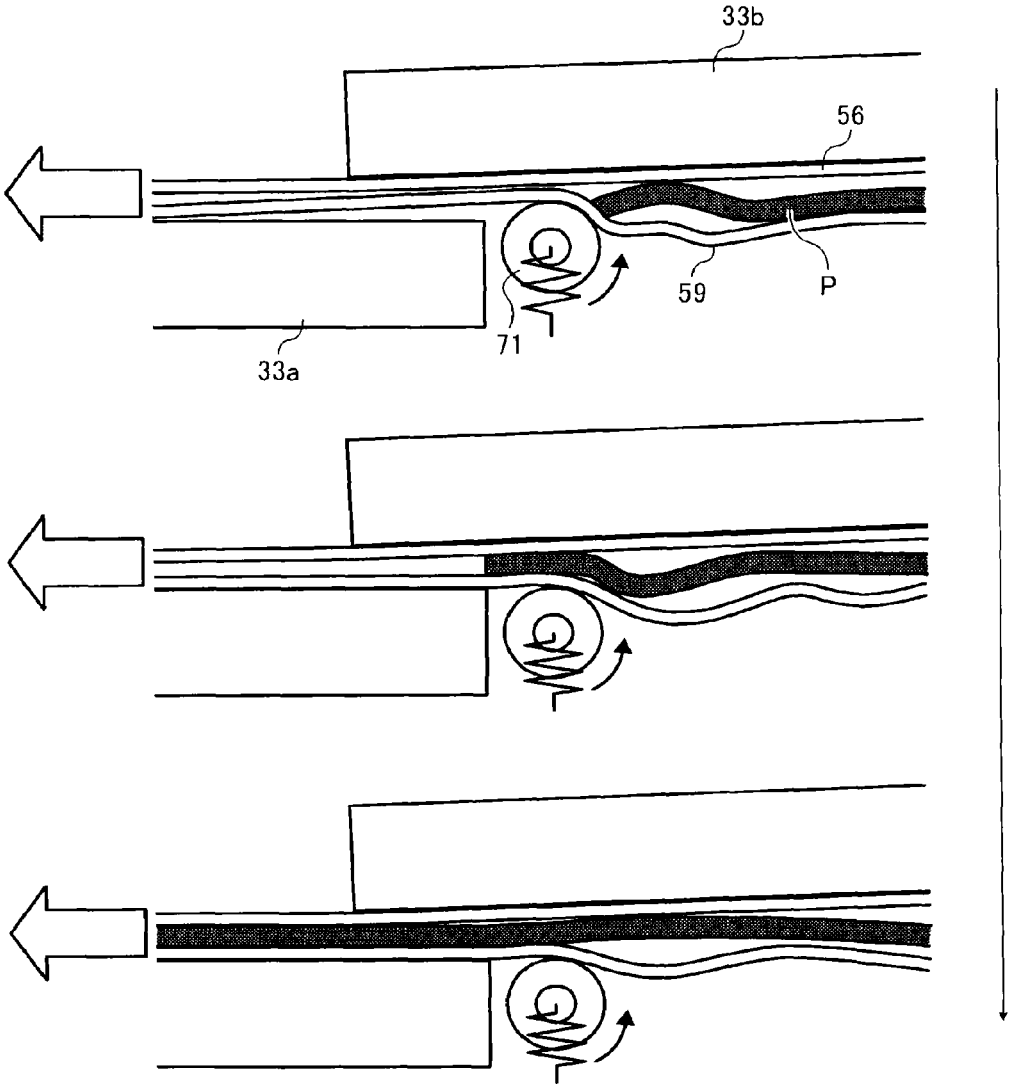
FIG. 32 is a schematic view of transport of a recording material in an overlapping area of cooling members.

Hence, for this exemplary embodiment, as illustrated in FIG. 31A, there is no gap in the transport direction C between the cooling members 33*a* and 33*b*, thus preventing an increase in error of an entry angle of the recording material as illustrated in FIG. 37A. In addition, even if the behavior of a recording material P during transport is unstable as illustrated in FIG. 32A, the guide member (in this case, the roller 71) adjusts an angle of the recording material P in a desired direction before the entry of the recording material P into the overlapping area of the cooling members 33*a* and 33*b*, thus preventing the recording material P from being caught on the cooling member 33*a* as illustrated in FIG. 37B. Furthermore, the cooling members 33*a* and 33*b* partially overlap each other in the transport direction C. Such a configuration allows more downsizing than a configuration in which the cooling members 33*a* and 33*b* do not overlap each other, and reduces transport resistance as compared with a configuration in which the cooling members 33*a* and 33*b* entirely overlap each other. The configuration employing the guide plate 72 also obtains effects equivalent to those of the configuration employing the roller 71.

Figure 33:
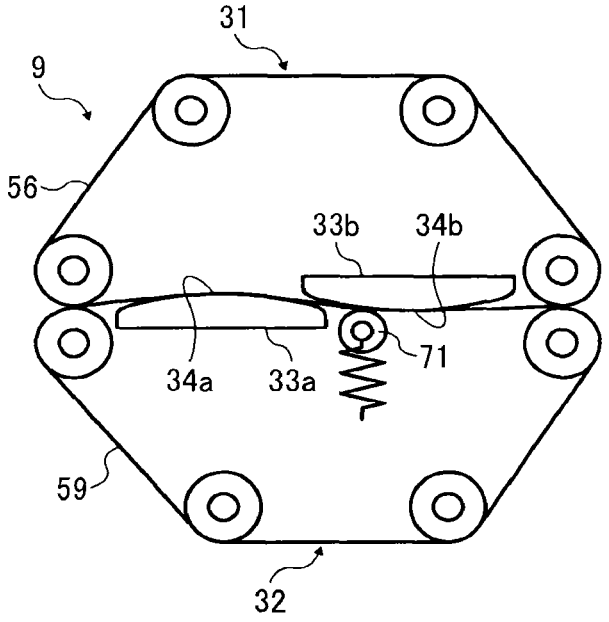
FIG. 33 is a side view of a cooling device according to an exemplary embodiment of this disclosure.

Next, a cooling device 9 according to an exemplary embodiment of this disclosure is described below with reference to FIG. 33.

The cooling device 9 according to this exemplary embodiment includes features of the above-described exemplary embodiments illustrated in FIGS. 26A to 32. In other words, for the cooling device 9 illustrated in FIG. 33, opposed cooling members 33*a* and 33*b* partially overlap each other in a transport direction C. Heat absorbing surfaces 34*a* and 34*b* of the cooling members 33*a* and 33*b* to contact belts 59 and 56, respectively, are not flat but convex. Both ends of each of the heat absorbing surfaces 34*a* and 34*b* in the transport direction C have curved surfaces. The cooling device 9 also has a roller 71 serving as guide member. The roller 71 guides a recording material P from a non-overlapping area to an overlapping area of the cooling member 33*b* and the cooling member 33*a*. Such a configuration allows more reliable transport of the recording material P in the overlapping area of the cooling members 33*a* and 33*b*.

Next, a cooling device 9 according to an exemplary embodiment of this disclosure is described below with reference to FIG. 34.

Figure 34:
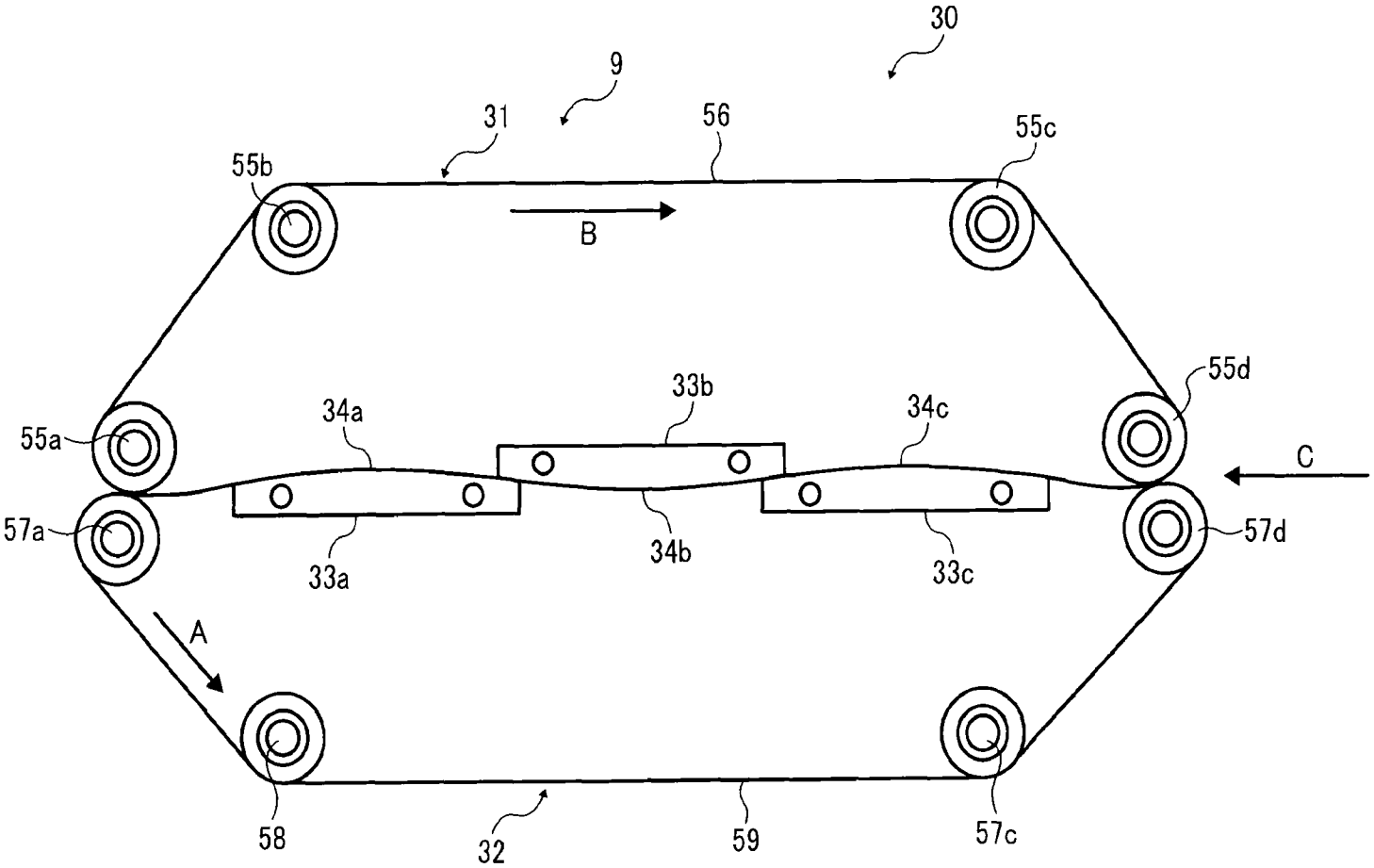
FIG. 34 is a side view of a cooling device according to an exemplary embodiment of this disclosure.

In the cooling device 9 illustrated in FIG. 34, three cooling members 33*c*, 33*b*, and 33*a* serving as liquid cooling jackets are arranged in an order of lower, upper, and lower sides in the transport direction C. Heat absorbing surfaces 34*c*, 34*b*, and 34*a* are not flat but convex. Here, upper end surfaces of the heat absorbing surfaces 34*a* and 34*c* of the cooling member 33*a* and 33*c* disposed at the lower side are disposed upper than a lower end surface of the heat absorbing surface 34*b* of the cooling member 33*b* disposed at the upper side. The opposed cooling members 33*a* and 33*b* partially overlap each other in the transport direction C. The opposed cooling members 33*b* and 33*c* partially overlap each other in the transport direction C. A belt 59 at a lower side has a function as a guide member to guide transport of the recording material P to an area of the belt 59 at an upper side and guide a leading end of the recording material P to the overlapping area in which the cooling member 33*b* at the upper side overlaps the cooling member 33*a* or 33*c* at the lower side. Such a configuration obtains effects equivalent to those of the above-described exemplary embodiments.

Figure 35:
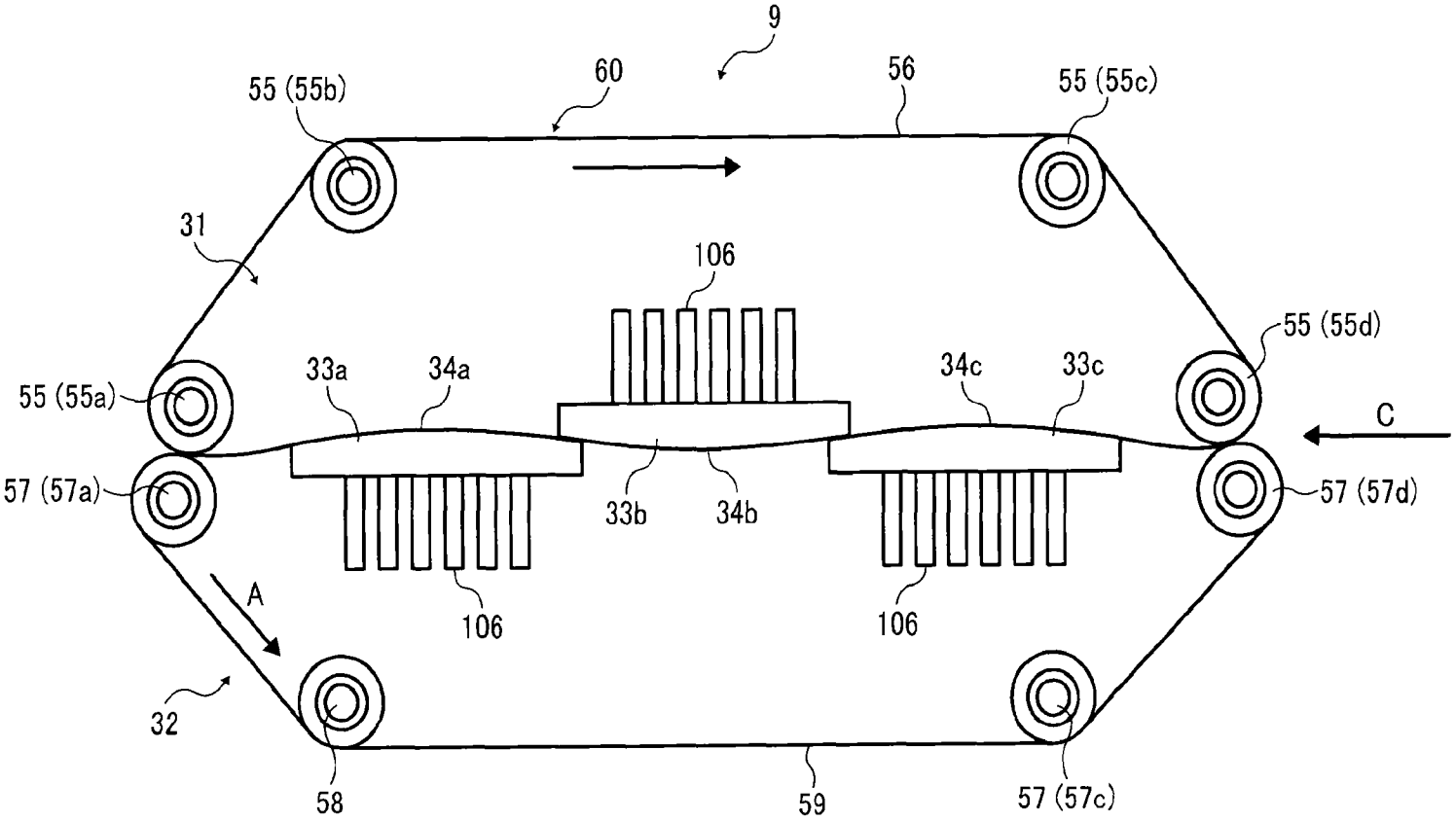
FIG. 35 is a side view of a cooling device according to an exemplary embodiment of this disclosure.

Exemplary embodiments of this disclosure are not limited to the cooling device 9 employing the cooling-liquid circuit 44 in FIG. 5. For example, as illustrated in FIG. 35, a cooling device 9 according to an exemplary embodiment includes a radiation facilitating part 106. As the radiation facilitating part 106, for example, an air-cooling heat sink having multiple fins is employed. In such a case, the relative positions between the heat absorbing surfaces 34*a*, 34*b*, and 34*c* and the belts 56 and 59 described in any of the above-described exemplary embodiments are also applicable to this exemplary embodiment. As described above, use of the air-cooling heat sink obviates use of the cooling-liquid circuit 44, thus allowing downsizing and cost reduction of the apparatus.

Next, a cooling device 9 according to an exemplary embodiment of this disclosure is described below with reference to FIG. 36.

Figure 36:
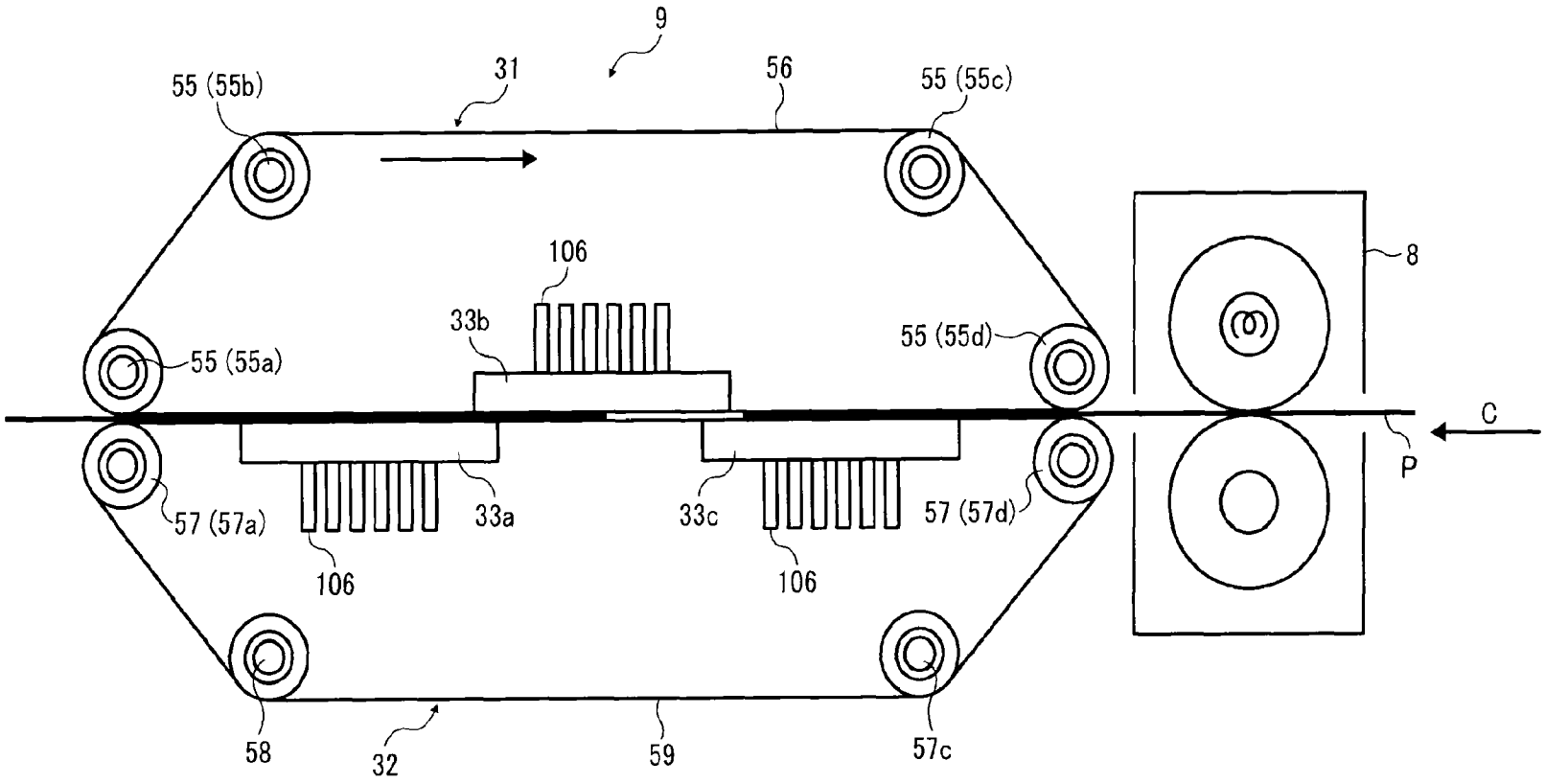
FIG. 36 is a side view of a cooling device according to an exemplary embodiment of this disclosure.

For the cooling device 9 illustrated in FIG. 36, unlike the air-cooling heat sink illustrated in FIG. 35, the cooling member 33*b* has a flat heat absorbing surface 34*b* as a lower surface thereof, and the cooling members 33*a* and 33*c* have flat heat absorbing surfaces 34*a* and 34*c*, respectively, as upper surfaces thereof. The other configurations are similar to, if not the same as, those of the air-cooling heat sink illustrated in FIG. 35. It is to be noted that a roller or a guide plate serving as a guide member may be disposed near an end at a recording-material entry side of the cooling member 33*b* or the cooling member 33*a*.

It is to be noted that exemplary embodiments of this disclosure are not limited to the above-described exemplary embodiments. Various modifications are possible within the scope of the above teachings. For example, at least one of the above-described exemplary embodiments is applicable to a fixing device or an image forming apparatus having any suitable configuration. For example, such an image forming apparatus is not limited to a copier or printer but may be, for example, a facsimile machine or a multi-functional peripheral (device) having the foregoing capabilities.

In the above-described exemplary embodiments, the transport path of a recording material P in the cooling device 9 is formed in a crosswise direction. It is to be noted that, in some embodiments, the direction of the transport path is not limited to the crosswise direction but may be a diagonal direction or an upward and downward direction. In the above-described exemplary embodiments, the output tray 20 is disposed immediately downstream from the cooling device 9 in the recording-material transport direction. Alternatively, for example, a post-processing device or a reverse device may be disposed immediately downstream from the cooling device 9.

In addition, exemplary embodiments of this disclosure have, for example, the following aspects. In an aspect A of this disclosure, a cooling device includes belt rotation assemblies having cooling members to cool a recording material and belt members held by a plurality of rollers. The belt rotation assemblies are disposed opposing each other to sandwich and convey the recording material to cool the recording material. Each of the cooling members has a heat absorbing surface protruding in an arc surface shape. The heat absorbing surface is disposed on a corresponding one of the belt members to surface-to-surface contact an inner circumferential surface of the corresponding belt member. A peak surface of one of the heat absorbing surfaces at one side sandwiching a transport path of the recording material and a peak surface of the other of the heat absorbing surfaces at the other side sandwiching the transport path overlap each other in a direction crossing the transport direction of the recording material. A driving roller is disposed on only one of the belt rotation assemblies, and the other of the belt rotation assemblies is rotated by rotation of the one of the belt rotation assemblies.

In an aspect B of this disclosure, a cooling device includes belt rotation assemblies having cooling members to cool a recording material and belt members held by a plurality of rollers. The belt rotation assemblies are disposed opposing each other to sandwich and convey the recording material to cool the recording material. Each of the cooling members has a heat absorbing surface of a protruding (convex) shape. The heat absorbing surface is disposed on a corresponding one of the belt members to surface-to-surface contact an inner circumferential surface of the corresponding belt member. A peak surface of one of the heat absorbing surfaces at one side sandwiching a transport path of the recording material and a peak surface of the other of the heat absorbing surfaces at the other side sandwiching the transport path overlap each other in a direction crossing the transport direction of the recording material. A driving roller is disposed on only one of the belt rotation assemblies, and the other of the belt rotation assemblies is rotated by a friction force generated between the belt members opposing and contacting each other by rotation of the one of the belt rotation assemblies.

In an aspect C of this disclosure, a cooling device includes belt rotation assemblies having cooling members to cool a recording material and belt members held by a plurality of rollers. The belt rotation assemblies are disposed opposing each other to sandwich and convey the recording material to cool the recording material. Each of the cooling members has a heat absorbing surface of a protruding (convex) shape. The heat absorbing surface is disposed on a corresponding one of the belt members to surface-to-surface contact an inner circumferential surface of the corresponding belt member. A peak surface of one of the heat absorbing surfaces at one side sandwiching a transport path of the recording material and a peak surface of the other of the heat absorbing surfaces at the other side sandwiching the transport path overlap each other in a direction crossing the transport direction of the recording material. A driving roller is disposed on only one of the belt rotation assemblies, and the other of the belt rotation assemblies is rotated by a friction force generated between the belt members within the width of the heat absorbing surfaces by rotation of the one of the belt rotation assemblies.

In an aspect D of this disclosure, a cooling device according to any one of the above-described aspects A, B, and C also has the following configuration. That is, the center of a roller disposed at an entry part and an exit part of the recording material in the one of the belt rotation assemblies and the center of a roller disposed at the entry part and the exit part of the recording material in the other of the belt rotation assemblies are offset from each other in the recording-material transport direction. A contact portion of a belt relative to the roller in the one of the belt rotation assemblies is not in contact with a contact portion of a belt relative to the roller in the other of the belt rotation assemblies.

In an aspect E of this disclosure, a cooling device according to any one of the above-described aspects A, B, and C also has the following configuration. That is, the center of a roller disposed at an entry part and an exit part of the recording material in the one of the belt rotation assemblies and the center of a roller disposed at the entry part and the exit part of the recording material in the other of the belt rotation assemblies are offset from each other in the recording-material transport direction. The roller disposed in the one of the belt rotation assemblies and the roller disposed in the other of the belt rotation assemblies overlap each other in the direction crossing the recording-material transport direction.

What is claimed is:

1. A conveyance material cooling device, comprising:

a first belt to convey a conveyance material, the belt wound around rollers without a heater within a loop of the first belt;

at least one cooler within the loop of the first belt to cool the conveyance material, the cooler including a fluid flowing path;

a first upstream roller within the loop of the first belt, the first upstream roller at an entry of the conveyance material to the first belt;

a first downstream roller within the loop of the first belt, the first downstream roller at an exit of the conveyance material from the first belt, a diameter of the first downstream roller being greater than a diameter of the first upstream roller;

a second belt to convey the conveyance material together with the first belt;

a second upstream roller within a loop of the second belt, the second upstream roller at an entry of the conveyance material to the second belt; and a second downstream roller within the loop of the second belt, the second downstream roller at an exit of the conveyance material from the second belt, the second downstream roller being downstream from the first downstream roller in a conveyance direction, wherein the first upstream roller is disposed at a position without an opposing roller at an interior of the second belt.

2. The conveyance material cooling device of claim 1, wherein:

a diameter of the second downstream roller is greater than a diameter of the second upstream roller.

3. The conveyance material cooling device of claim 2, wherein a diameter of the second downstream roller is greater than a diameter of the first upstream roller.

4. The conveyance material cooling device of claim 1, wherein the second downstream roller is a driving roller.

5. The conveyance material cooling device of claim 1, wherein the cooler includes a contact surface to contact the first belt, the contact surface being flat.

6. An image forming apparatus, comprising:

the conveyance material cooling device according to claim 1;

an image forming part to form an unfixed toner image on the conveyance material; and a heater to heat toner on the conveyance material.

7. The conveyance material cooling device of claim 1, wherein:

a liquid coolant flows in the fluid flowing path.

8. A conveyance material cooling device, comprising:

a belt to convey a conveyance material, the belt wound around rollers without a heater within a loop of the belt;

an upstream roller within the loop of the belt, the upstream roller at an entry of the conveyance material to the belt;

a downstream roller within the loop of the belt, the downstream roller at an exit of the conveyance material from the belt, the downstream roller being a driving roller; and at least one cooler to cool the conveyance material, the cooler contacting an outer surface of the belt at which a conveyance path and the belt face each other, the cooler including a fluid flowing path, wherein the at least one cooler is stationary as the belt is moving, and wherein the outer surface of the belt contacts the conveyance material during conveyance of the conveyance material.

9. The conveyance material cooling device of claim 8, further comprising a contacting roller to convey the conveyance material together with the belt.

10. The conveyance material cooling device of claim 8, further comprising a conveyance guide to guide the conveyance material, the conveyance guide facing the belt.

11. An image forming apparatus, comprising:

the conveyance material cooling device according to claim 8;

an image forming part to form an unfixed toner image on the conveyance material; and a heater to heat a toner on the conveyance material.

12. The conveyance material cooling device of claim 8, further comprising:

a second cooler to cool the conveyance material, the second cooler contacting an interior of the belt.

13. The conveyance material cooling device of claim 8, wherein:

a liquid coolant flows in the fluid flowing path.

* * * * *